US006675735B1

(12) United States Patent
Bourn

(10) Patent No.: US 6,675,735 B1
(45) Date of Patent: Jan. 13, 2004

(54) HYDROFOIL SAIL CRAFT

(76) Inventor: Stephen Bourn, 77 Goodall Crescent, Salisbury, South Australia, 5108 (AU)

( * ) Notice: Subject to any disclaimer, the term of this patent is extended or adjusted under 35 U.S.C. 154(b) by 0 days.

(21) Appl. No.: 09/831,090

(22) PCT Filed: Nov. 3, 1999

(86) PCT No.: PCT/AU99/00956

§ 371 (c)(1),
(2), (4) Date: May 2, 2001

(87) PCT Pub. No.: WO00/26083

PCT Pub. Date: May 11, 2000

(30) Foreign Application Priority Data

Nov. 2, 1998 (AU) ..... PP6914

(51) Int. Cl.[7] ..... B63B 1/16

(52) U.S. Cl. ..... 114/273; 114/274; 114/280; 114/39.24; 114/39.31

(58) Field of Search ..... 114/271, 274, 114/272, 273, 278, 280, 39.21, 39.24, 39.31

(56) References Cited

U.S. PATENT DOCUMENTS

| | | | | |
|---|---|---|---|---|
| 2,804,038 A | * | 8/1957 | Barkla | 114/272 |
| 3,094,961 A | * | 6/1963 | Smith | 114/281 |
| 3,459,146 A | | 8/1969 | Hallmark | |
| 3,800,724 A | * | 4/1974 | Tracy | 114/39.24 |
| 3,981,258 A | | 9/1976 | Smith | |
| 4,095,549 A | * | 6/1978 | Williams | 114/273 |
| 4,164,909 A | | 8/1979 | Ballard | |
| 4,228,750 A | | 10/1980 | Smith et al. | |
| 5,038,694 A | * | 8/1991 | Yamada et al. | 114/123 |
| 5,076,186 A | | 12/1991 | Girard | |
| 5,113,775 A | | 5/1992 | Imhoff | |
| 5,682,831 A | * | 11/1997 | Yokoi | 114/123 |

FOREIGN PATENT DOCUMENTS

| | | |
|---|---|---|
| FR | 2676705 | 5/1991 |
| FR | 2 697 794 | 5/1994 |

OTHER PUBLICATIONS

Proceedings of the Amateur Yacht Research Society, Weymouth, with discussion of a Sailing Craft and illustration by Jonathan Howse [sic; Howes] Oct. 1998, cover page, pp. 6–11.

Copy of an e–mail from Jonathan Howes to John Perry which was forwarded Nov. 2, 1998 to the moderator of the Amateur Yacht Research Society Digest.

* cited by examiner

*Primary Examiner*—Stephen Avila
(74) *Attorney, Agent, or Firm*—Knobbe, Martens, Olson & Bear, LLP

(57) ABSTRACT

A sailing craft including a single hydrofoil assembly, an aerofoil assembly, and a hull assembly with a rigid beam interconnecting the hydrofoil assembly, the aerofoil assembly, and the hull assembly. The hull is separate and displaced from the hydrofoil assembly and is, in use, supported above the water by the rigid beam. The hydrofoil assembly, the aerofoil assembly, and the hull assembly are preferably interconnected such that the hydrofoil assembly and the aerofoil assembly are disposed at opposite ends of the rigid beam and the hull is connected to the beam therebetween.

32 Claims, 16 Drawing Sheets

Velocities for constant $V_T$ and β

$V_U$ and associated $V_A$, V and ratios, $V_{max}$ and $-V_D$ versus $\beta$

Example plot of $\phi_{BA}$ versus $\phi_{BH}$ for $\lambda$=0.5 and $\theta$=30°

Example plot of $\beta=\varepsilon_{IA}+\varepsilon_{IH}$ versus $\phi_{BA}$ for $\varepsilon_A=\varepsilon_H=7.5°$, $\lambda=0.5$ and $\theta=30°$

HYDROFOIL SAIL CRAFT

FIELD OF THE INVENTION

The present invention relates to an improved sail craft. In particular, the invention relates to a wind powered sailing craft with improved speed performance as compared with the prior art.

BACKGROUND OF THE INVENTION

Sail powered craft have been well known for many years and have been used for many purposes including commercial and military applications. In more recent times, with the advent of active propulsion systems, wind powered sail craft have generally been restricted to leisure activities.

Popular forms of modem day sail craft include yachts, catamarans and sail boards. Whilst the applications for this type of craft have become more restricted in recent times, there is still a great deal of,interest for leisure applications. The leisure market is substantial and the competition for new and improved designs is significant.

In particular, there is substantial competition to produce a sail craft with superior speed performance as compared with prior art designs. In this regard, the competition to produce sail craft of ever improved speed performance is similar to the competition to produce solar powered or man powered vehicles of greater performance than their predecessors. A notable example of this type of craft that has been designed to produce the best known speed performance is the Australian designed "Yellow Pages Endeavour" which is a wind powered sail craft that has recorded an average top sailing speed of 46.52 knots in a 19 knot true wind speed with minimal wave height.

However, the "Yellow Pages Endeavour" is restricted in that it has a reduced handling capability as compared with generally available craft. The most significant of these is that the craft can only sail on one tack.

The present invention is intended to provide a wind powered sail craft with superior speed performance as compared with the prior art. In addition, it is also intended to provide a wind powered sail craft that provides an improved speed performance without sacrificing handling capabilities as generally occurs in the prior art.

Some of the basic nomenclature used throughout the specification is introduced with reference to FIG. 1 that sets out the fundamental principles of craft velocity in relation to true wind velocity. In particular, FIG. 1 diagrammatically represents the theoretical maximum craft velocity that can be achieved with any type of craft. An analysis of FIG. 1 produces a number of relationships that are plotted in FIG. 2.

FIG. 1 is a vector diagram detailing a locus of all possible velocities of a sail craft, designated V, for a given true wind velocity, designated $V_T$, and apparent wind angle, designated β. The velocity of the craft can be projected into a downwind and an upwind component with the maximum downwind and upwind velocities achievable designated $V_D$ and $V_U$ respectively.

The apparent wind velocity is designated $V_A$. For a given value of true wind $V_T$ and apparent wind angle β, the range of all possible craft velocities comprises an arc of a circle with the true wind velocity being a chord. The arc representing all possible craft velocities is designated $V_{POSS}$. The maximum possible craft velocity occurs when the velocity V intersects the centre of the circle $V_{POSS}$ and extends over the diameter of the circle. At this position, the maximum velocity achievable is designated $V_{max}$. As the circle $V_{POSS}$ designates the range of all possible craft velocities it can be readily seen that the maximum upwind component of velocity $V_U$ and downwind component of velocity $V_D$, are projections from the circle of $V_{POSS}$ parallel to the true wind velocity $V_T$.

From the vector diagram of FIG. 1, it can be readily derived that the maximum speed, $V_{max}$, is given by:

$$V_{\max} = \frac{V_T}{\sin\beta}$$

The maximum velocity made good to windward, that is upwind component, $V_U$, is given by $$V_U = \frac{V_{\max} - V_T}{2}$$

The maximum velocity made good downwind, $V_D$, is given by $$V_D = \frac{V_{\max} + V_T}{2}$$

The boat speed associated with $V_U$ is given by $$V = \frac{\sin\left(\frac{\pi}{4} - \frac{\beta}{2}\right)}{\sin\beta} V_T$$

The corresponding apparent wind is given by $$V_A = \frac{\sin\left(\frac{\pi}{4} + \frac{\beta}{2}\right)}{\sin\beta} V_T$$

The corresponding ratio of boat speed to apparent wind speed is given by $$\frac{V_A}{V} = \sqrt{\frac{1 + \sin\beta}{1 - \sin\beta}}$$

These relationships are plotted for varying apparent wind angle β and appear in FIG. 2. The vertical axis of the plot in FIG. 2 represents units of true wind speed with one unit representing the true wind speed. The horizontal axis represents varying apparent wind angle from 0 degrees to 90 degrees.

As can be seen from the plots in FIG. 2, the plot representing the maximum velocity of the craft, $V_{max}$, has a value approaching the limit of the true wind speed as the apparent wind angle approaches 90 degrees and that the maximum velocity increases with a decreasing apparent wind angle. The "Yellow Pages Endeavour" achieved a top speed of approximately 2.5 times the true wind speed on the day of the test, and as can be seen from the plot, this represents an apparent wind angle of approximately 25 degrees.

The true wind angles, designated γ, for maximum velocity and maximum up wind and down wind components are as follows:

$V_{max}$ is achieved at $$\gamma = \frac{\pi}{2} + \beta$$

VU is achieved at $$\gamma = \frac{\pi}{4} + \frac{\beta}{2}$$

VD is achieved at $$\gamma = \frac{3\pi}{4} + \frac{\beta}{2}$$

However, it is very difficult to obtain low values of apparent wind angle with a sail craft whilst at the same time being able to sail and control the craft.

The analysis presented above and the diagrammatic representations of FIGS. 1 and 2 are applicable to all types of sailing craft. They effectively represent the theoretical principles that apply irrespective of the structure of the craft.

Whilst the above analysis is generally applicable to any type of craft, the following discussion will focus upon the general principles relating to the structure of crafts and leads to a detailed discussion of the specific structure of the craft of the present invention.

In the design of high performance sailcraft it is necessary to consider three principle classes of force, namely aerodynamic, hydrodynamic and gravitational. Hydrostatic forces may be considered to be negligible once the craft has sufficient speed. The resultant of the gravitational forces is a single force acting through the centre of mass. The aerodynamic forces can be reduced to a single resultant force and possibly a residual torque with an axis parallel to the line of action of the resultant force. A similar reduction also applies to the hydrodynamic forces. Ideally the residual torques will be negligible, leaving just the resultant aerodynamic, hydrodynamic and gravitational forces to consider. If three non parallel forces act on a rigid body, then for equilibrium the forces must sum to zero, must be coplanar and must be concurrent.

Additionally, it has been recognised for some time that the analysis of the operation of sail craft can be considered from the perspective of considering the water and the air as two interfacing fluids of substantially different density. As such, sailing craft reside at the interface of the two fluids and impinge into the fluids; the hydrofoil extending into the water and the aerofoil extending into the air. Exploiting this interface is effectively the basis of the operation of sailing craft.

In most conventional sailing craft designs, the hydrofoil and the aerofoil are in generally vertical alignment. In the case of a yacht, the keel forms the hydrofoil and the sail forms the aerofoil. In this instance, the analysis of the various forces acting upon the vessel to produce the motion of the vessel is relatively straightforward as most of the forces acting upon the hydrofoil and aerofoil lie substantially parallel to the horizontal plane of the interface between the two fluids. As will be appreciated by those with a basic understanding of vector addition, the task of analysing resultant forces is greatly simplified if the forces can be represented within a single plane. It is conventional to consider healing moments independently. Pitching moments are often not considered formally. Support of the craft's weight is also considered independently for both low and high performance craft, which are supported by hydrostatic or dynamic forces, respectively.

Alternative sailing craft designs have been proposed that do not maintain the standard generally vertical alignment between the hydrofoil and the aerofoil. However, it appears to the applicant, with respect to prior art designs that do not have a generally aligned hydrofoil and aerofoil, that there have been limitations in the analysis of forces and the interactions of forces upon the sailing craft. This failure to fully analyse the interacting forces has led to a failure to correctly understand the operation of those forces and hence a failure to optimise the performance of the craft.

In particular, the applicant has recognised that for a correct analysis of the forces acting upon a sailing craft, it is important to consider the forces projected onto the interface (ie. the horizontal plane) as well as the actual forces acting on the craft. For conventional designs that have their actual forces substantially parallel to the horizontal plane the conventional analysis has been correct for the structure of the craft. However, when deviating from conventional structures, the failure to recognise this important aspect leads to non-optimal structural designs.

In the present invention, the applicant has applied the recognition of the need to consider the projection of forces onto the horizontal plane to the analysis of the structure of sailing craft, and has developed an improved sail craft as compared with the prior art.

As part of this recognition, the applicant realised that to effect an improved structural design, various components of the craft would require various degrees of freedom. Accordingly, and unlike the "Yellow Pages Endeavour", the improved sail craft of the present invention can sail on both tacks. As a result of this analysis, the applicant has developed a sailing craft with theoretically improved performance as compared with the prior art without sacrificing the ability to sail on both tacks.

SUMMARY OF THE INVENTION

The invention provides a wind powered craft including a single hydrofoil assembly, an aerofoil assembly and a hull, with a rigid beam interconnecting the hydrofoil assembly, the aerofoil assembly and the hull, wherein the hull is separate and displaced from the hydrofoil assembly and is, in use, supported above the water by the rigid beam.

It is preferred to connect the hydrofoil assembly, the aerofoil assembly and the hull such that the hydrofoil assembly and the aerofoil assembly are disposed at opposite ends of the rigid beam and the hull is connected to the beam at a position therebetween. It is further preferable that, in use, the aerofoil assembly resides downwind from the hydrofoil assembly.

Preferably the hull is connected to the rigid beam such that when supported above the water, the hull is able to freely rotate about a generally vertical axis. Without any direct control of the yaw motion of the hull, the hull will, when supported above the water, adopt an orientation dependent upon the airflow past the hull. However, the craft may include a rudder or rudders connected to the hull to stabilise yaw motion of the hull. The hull may also include a boom to which a rudder or rudders are connected. It is also preferred that the hydrofoil assembly include a hydrofoil member that, in use, is capable of rotation about an axis generally aligned with the flow of water past the hydrofoil member and the aerofoil assembly include an aerofoil member that, in use, is capable of rotation about an axis generally aligned with the flow of air past the aerofoil member.

Additionally, it is preferred that the hydrofoil member be capable, in use, of rotation about an axis generally transverse to the flow of water past the hydrofoil member, the axis also being generally aligned with the lateral axis of the hydrofoil member. It is also preferable that the aerofoil member be capable, in use, of rotation about an axis generally transverse to the flow of air past the aerofoil member, the axis also being generally aligned with the lateral axis of the aerofoil member.

As well as free rotation of the hull about a generally vertical axis, it is preferred that the hydrofoil assembly and the aerofoil assembly be connected to the rigid beam such that, in use, they may each rotate freely about a generally vertical axis such that the lateral axes of the hydrofoil and aerofoil members are maintained generally transverse to the flow of water or air passing the foils.

In a preferred embodiment, the hydrofoil assembly includes a hydrofoil boom and stabilising foils attached thereto, the hydrofoil boom being fixedly attached to the assembly and extending downstream of the hydrofoil member and assisting to maintain the hydrofoil member lateral axis generally transverse to the flow of water passing the hydrofoil member and acting to stabilise yaw movements of the hydrofoil assembly.

In addition, in a preferred embodiment, the aerofoil assembly includes an aerofoil boom and stabilising foils attached thereto, the aerofoil boom being fixedly attached to the assembly and extending downwind of the aerofoil member and assisting to maintain the aerofoil member lateral axis generally transverse to the flow of air passing the aerofoil member and acting to stabilise yaw movements of the aerofoil assembly.

To reduce hydrodynamic drag, it is preferred that the hydrofoil member be separate and displaced from the connection between the rigid beam and the hydrofoil assembly. However, in addition to avoiding immersion of the connection it is preferable that the axes representing rotation of the hydrofoil assembly about a generally vertical axis, and rotation of the hydrofoil member about an axis generally aligned to the flow of water past the hydrofoil member intersect.

In one embodiment, the hull includes a rudder disposed rearwardly and upwardly from the hull, and in another embodiment, the hull includes a rudder disposed rearwardly and downwardly from the hull. In yet a further embodiment, the hull includes a rudder disposed rearwardly and upwardly from the hull and a rudder disposed rearwardly and downwardly from the hull. In this particular embodiment, the rudder disposed rearwardly and upwardly and the rudder disposed rearwardly and downardly from the hull are capable, in use, of being independently controlled.

In a particularly preferred embodiment, the hull includes float members attached thereto to provide stability to the hull whilst resting upon the surface of the water.

The stabilising foils attached to the foil booms and the hull may include generally horizontally aligned foils to contribute to the control of the pitch of the rigid beam. To a lesser extent, these stabilising foils may also assist roll stabilisation of the rigid beam. Pitch of the rigid beam will also be stabilised by the position of the centre of gravity being below the straight line joining the hydrodynamic centre of pressure and the aerodynamic centre of pressure. Accordingly, it is preferable that the centre of gravity of the craft reside below a straight line projected between the hydrodynamic and aerodynamic centres of pressure.

To gain improved performance, it is preferable to construct the craft such that the angle between the horizontal plane and the straight line joining the hydrodynamic centre of pressure and the aerodynamic centre of pressure, when in use, is as small as possible. Of course, this will impact upon other constraints in relation to the physical dimensions of remaining aspects of the craft in particular the span of the aerofoil and the width of the rigid beam. With respect to the foil assemblies, it is preferable to construct the foils such that at least one of the foils has a wide range of coefficient of lift.

To reduce drag, it is preferred that all elements of the craft be streamlined in accordance with aero and hydrodynamic principles. In particular, it is preferable that the rigid beam has a streamlined cross section to reduce drag forces imparted to the craft.

In a particularly preferred embodiment, the rigid beam comprises two distinct joined sections with an obtuse angle extending between the sections with the hull attached to the beam in the vicinity of the join, the section of the rigid beam connecting the hull to the aerofoil assembly including an aerodynamically shaped cowling or cover that extends for a substantial length along the longitudinal axis of that section of the beam with the cowling capable of rotation about the longitudinal axis of the beam such that it may adopt a position corresponding to the least aerodynamic drag. The orientation of the cowling will therefore depend upon the prevailing wind conditions during use and upon the tack. The section of the rigid beam connecting the hull to the hydrofoil assembly may also have a similar shaped cowling extending for a substantial length of that section. Alternatively this cowling could be symmetrical and fixed.

In another embodiment of the invention, the aerofoil member comprises a flexible and resilient member that is capable, in use, of twisting about an axis generally transverse to the flow of air past the aerofoil member, the axis also being generally aligned with the lateral axis of the aerofoil member.

In a particularly preferred embodiment, the aerofoil member is constructed from two substantially similar members that are capable of independent rotation about their lateral axes. Independently controlled rotation of the aerofoil members about their lateral axes enables rotation of the aerofoil members about an axis generally aligned with the flow of air past the aerofoil members to be effected. In this embodiment it is also preferable to include a hydrofoil member that is constructed from two substantially similar members that are capable of independent rotation about their lateral axes. Independently controlled rotation of the hydrofoil members about lateral axes enables rotation of the hydrofoil members about an axis generally aligned with the flow of water past the hydrofoil members to be effected.

DETAILED DESCRIPTION OF THE PREFERRED EMBODIMENT OF THE INVENTION

A preferred embodiment of the method of the invention will now be described in relation to the accompanying drawings. However, it is to be appreciated that the following description is not to limit the generality of the above description.

Figure 1:
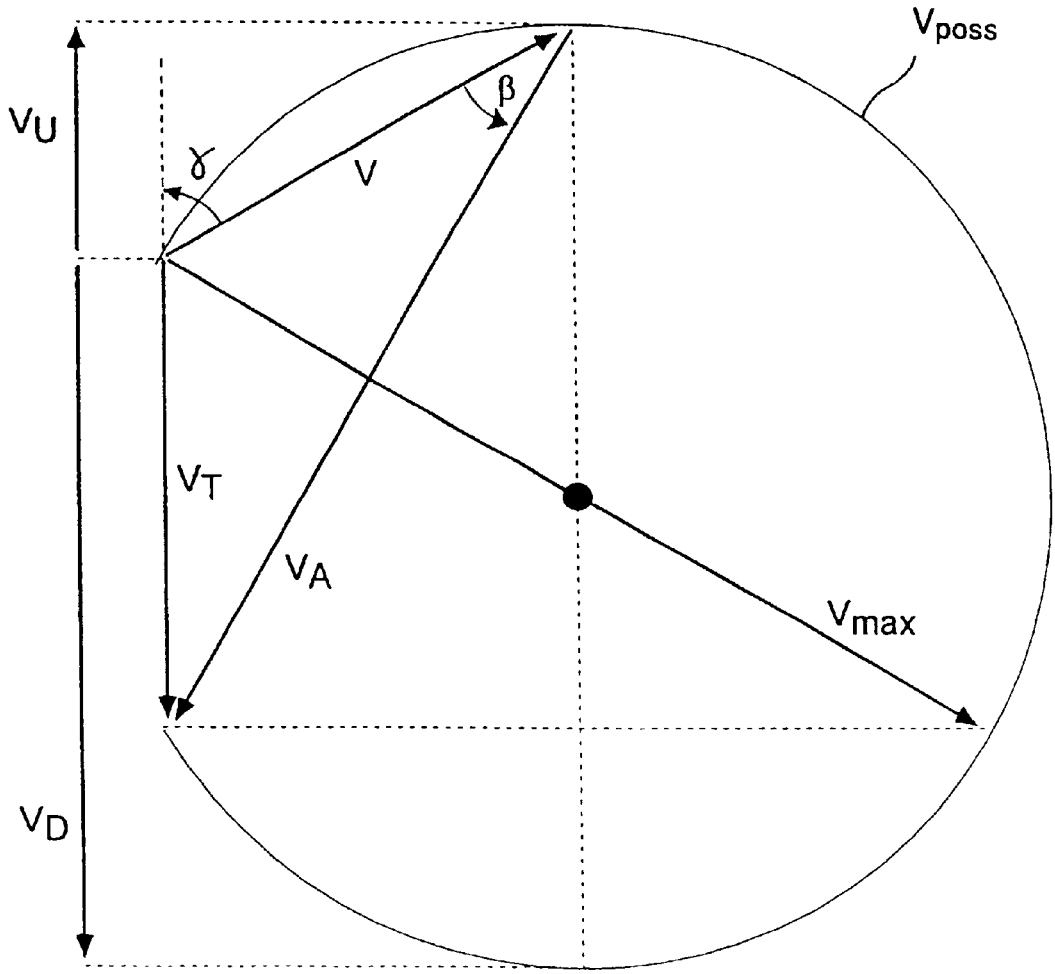
FIG. 1 is a vector diagram representing the velocity of a craft, the true wind velocity and the apparent wind velocity with a locus of the range of possible craft velocities.
Figure 2:
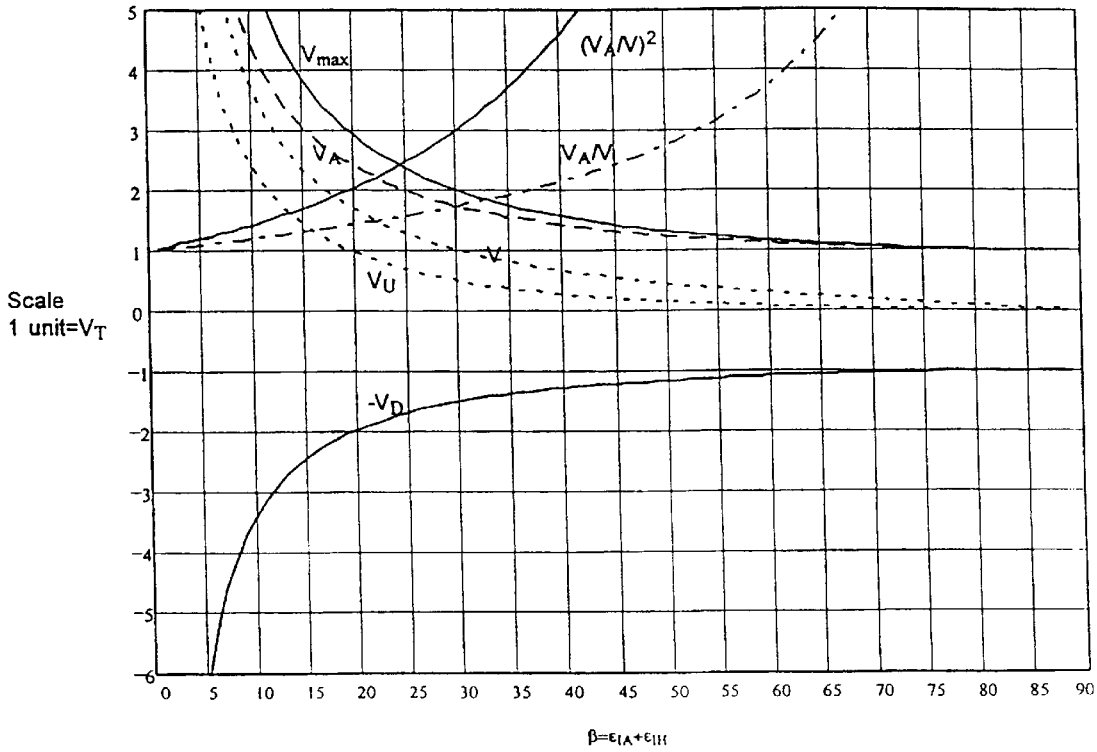
FIG. 2 is a plot of various parameters as they vary with the apparent wind angle.
Figure 3:
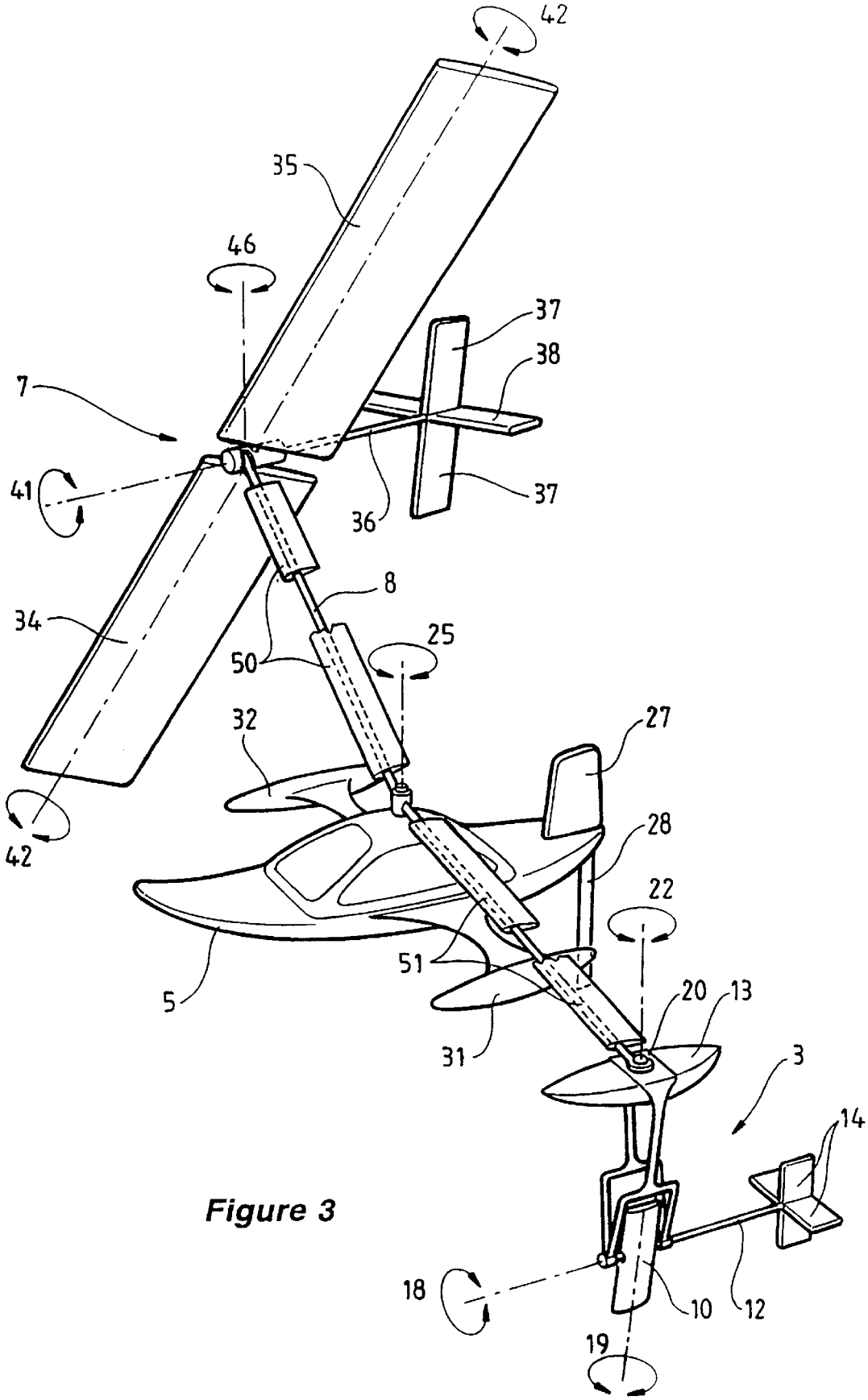
FIG. 3 is a perspective view of an improved sail craft according to the invention.
Figure 4B:
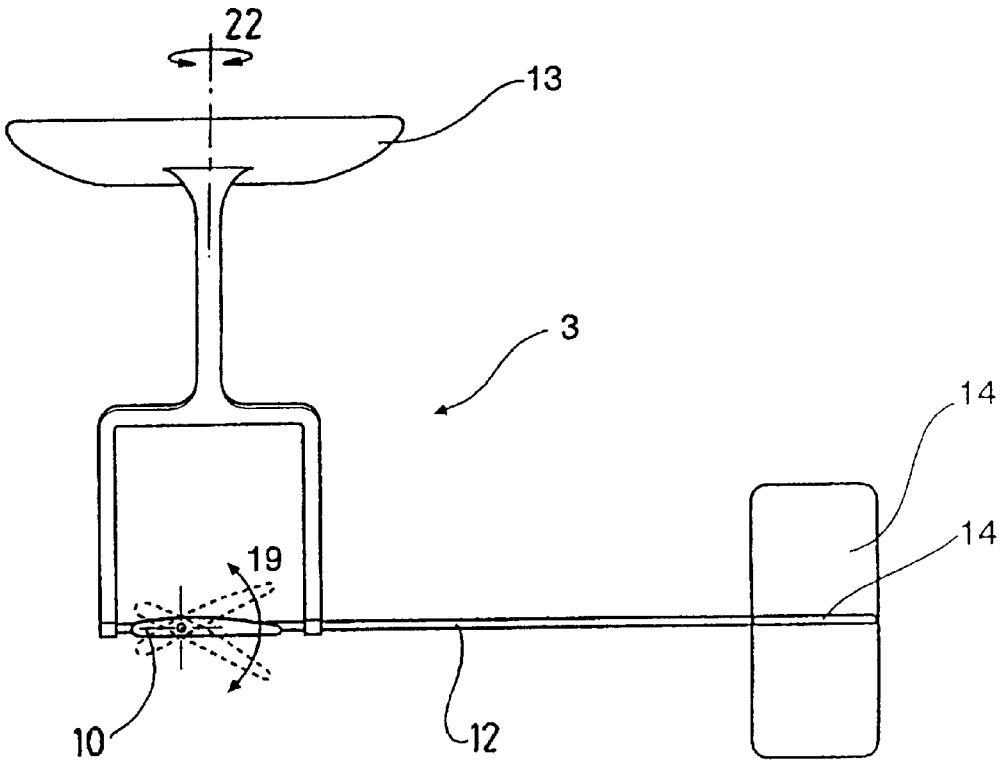
Figure 4A:
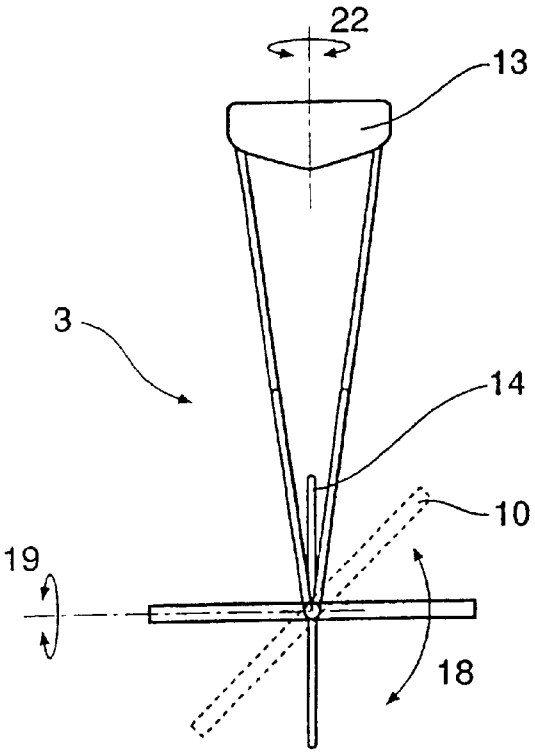
Figure 5A:
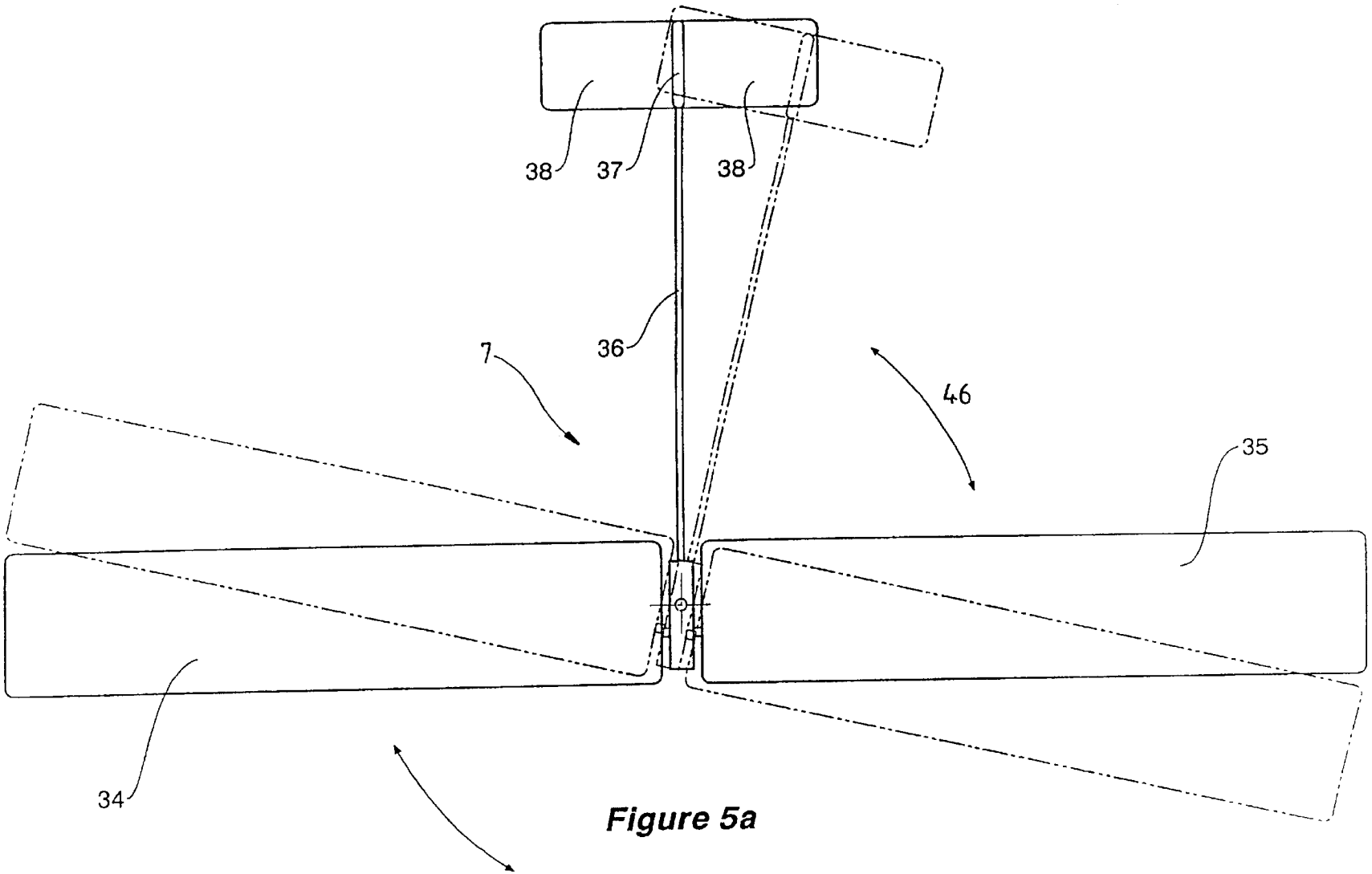
Figure 5B:
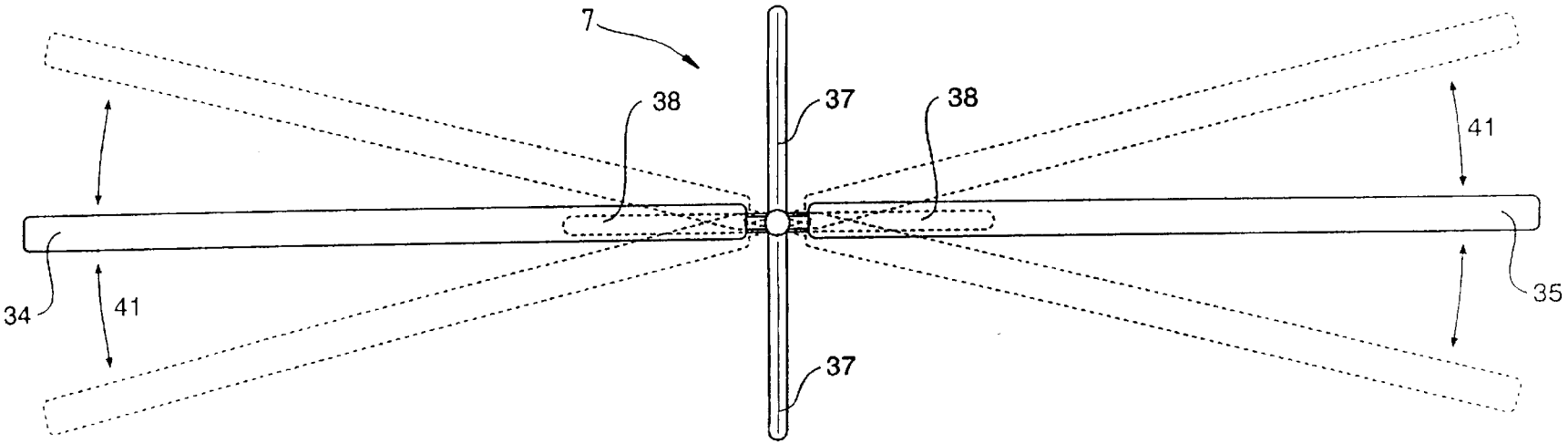
Figure 5C:
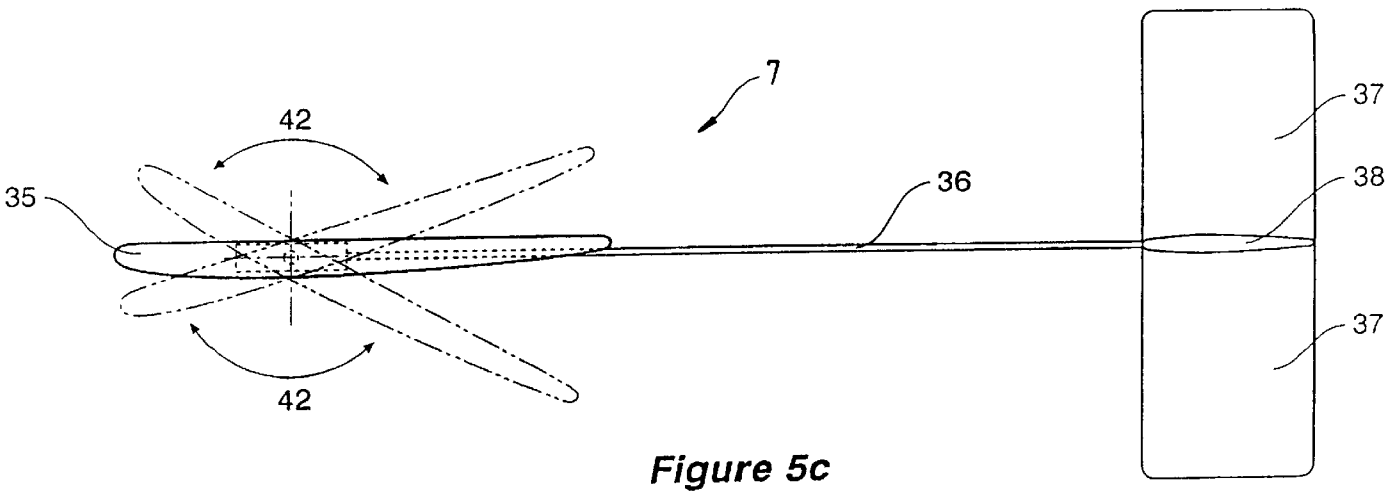
Figure 6A:
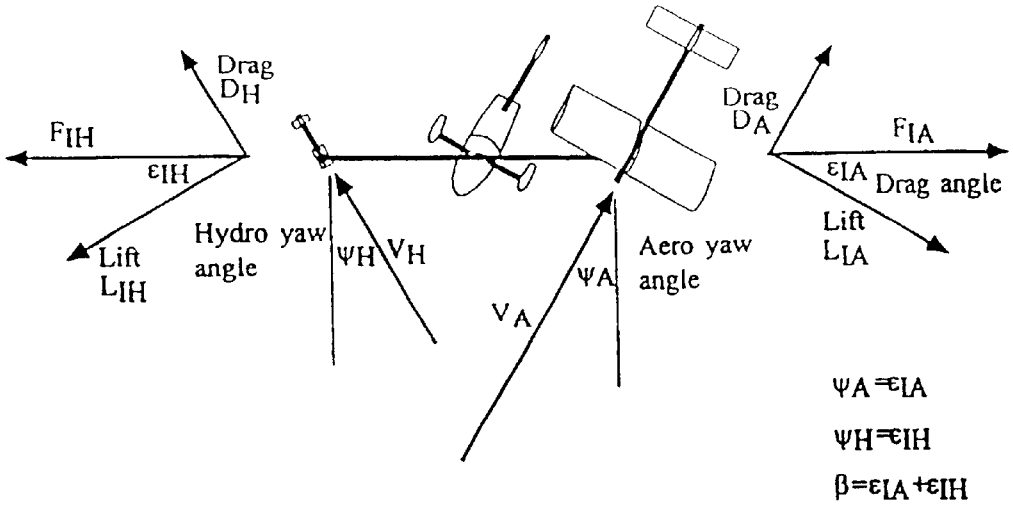
Figure 6B:
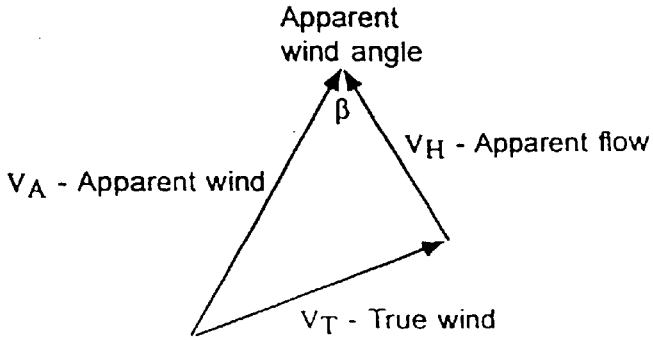
Figure 7A:
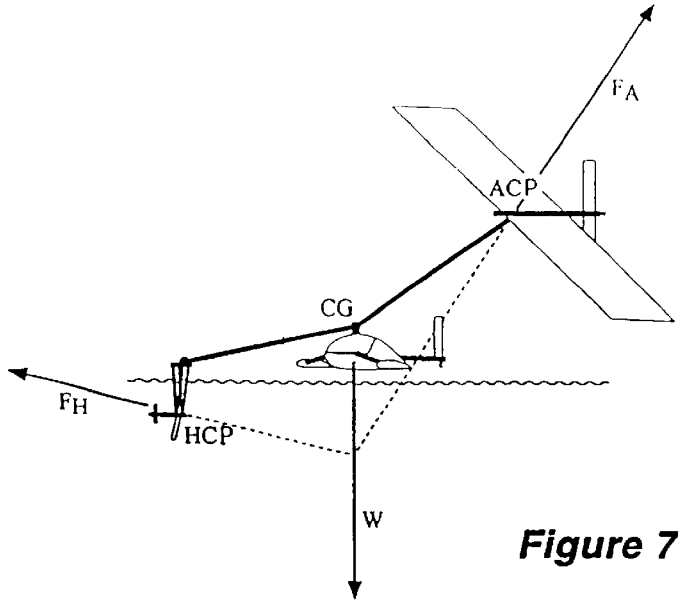
Figure 7B:
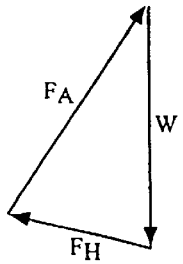
Figure 7C:
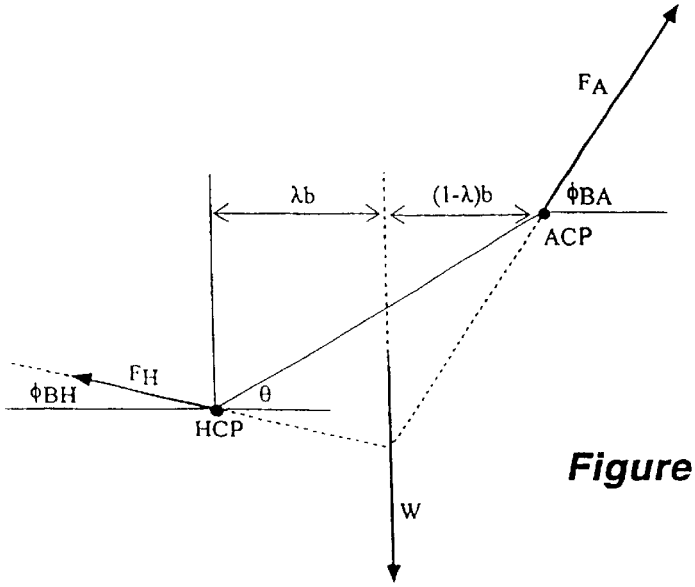
Figure 8:
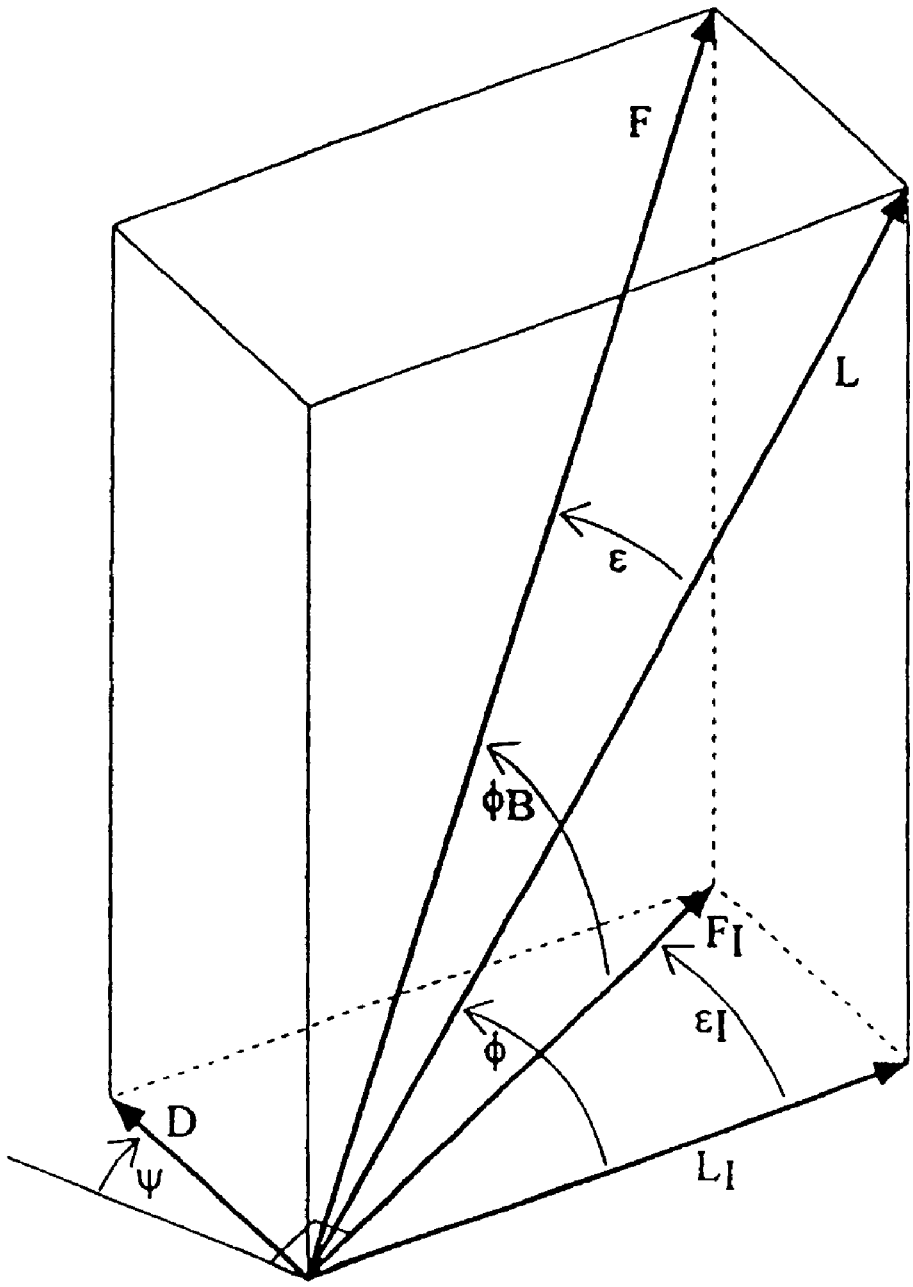

FIGS. 4*a* and 4*b* provide a front and side view of the hydrofoil assembly of FIG. 3;

FIGS. 5*a*, 5*b* and 5*c* provide a top, front and side view respectively of the aerofoil assembly of FIG. 3;

FIG. 6*a* is a top view of a sail craft according to the invention detailing various projected force vectors;

FIG. 6*b* is a vector diagram detailing the apparent wind and apparent flow (as depicted in FIG. 6*a*) and details the apparent wind angle;

FIG. 7*a* is a front view of a sail craft according to the invention detailing various force vectors. The figure represents the craft in use with the waterline passing through the struts of the hydrofoil yaw gimbal arrangement. In this figure, the lower sections of the hydrofoil assembly are immersed whilst the a remainder of the craft is airborne;

FIGS. 7*b* and 7*c* are vector diagrams detailing the various forces acting upon the rigid beam;

FIG. 8 is a diagrammatic representation of the decomposition of the forces and lift into the relevant components for analysis of the factors affecting the performance of the sailing craft of this invention.

Figure 9:
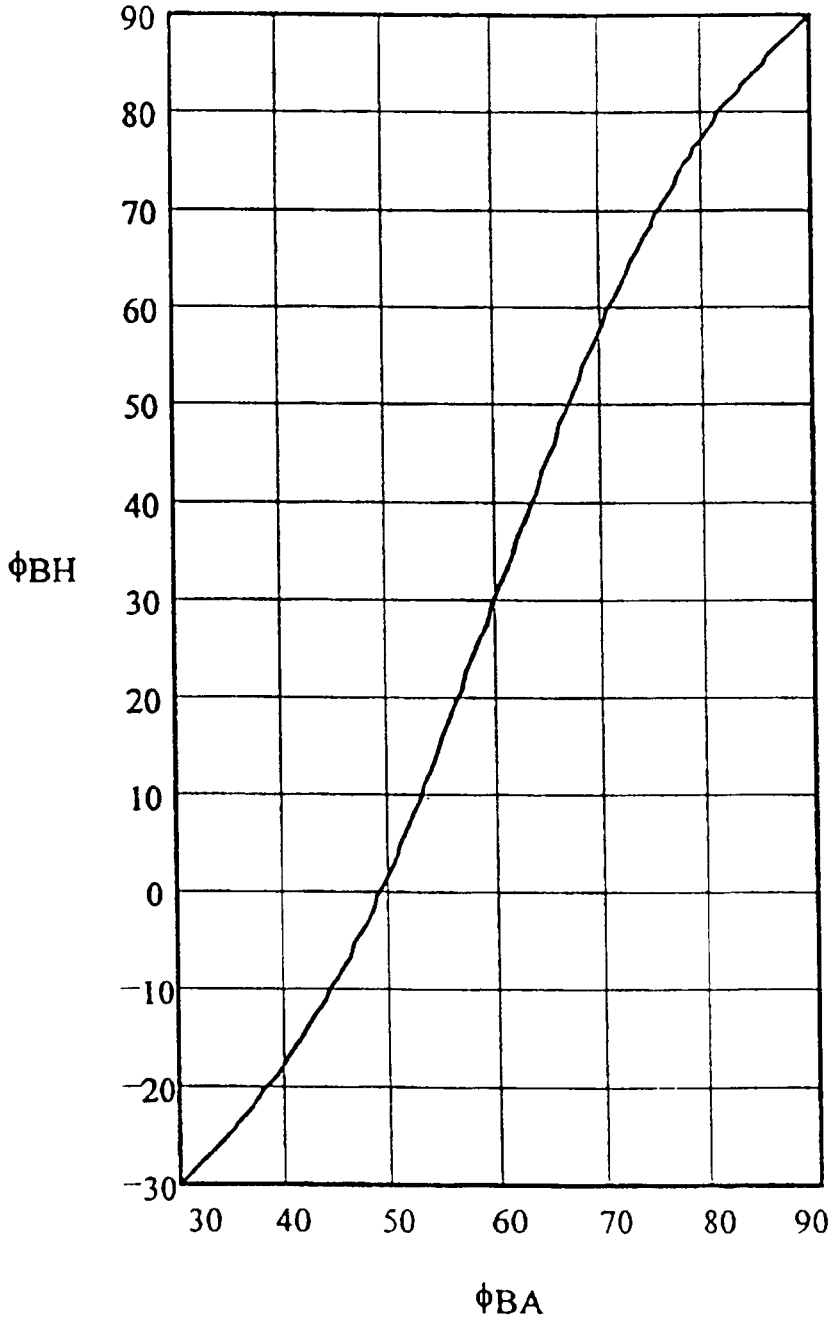

FIG. 9 is a plot of the relationship between the angles $\phi_{BA}$ and $\phi_{BH}$ for representative values of $\lambda$ and $\theta$.

Figure 10:
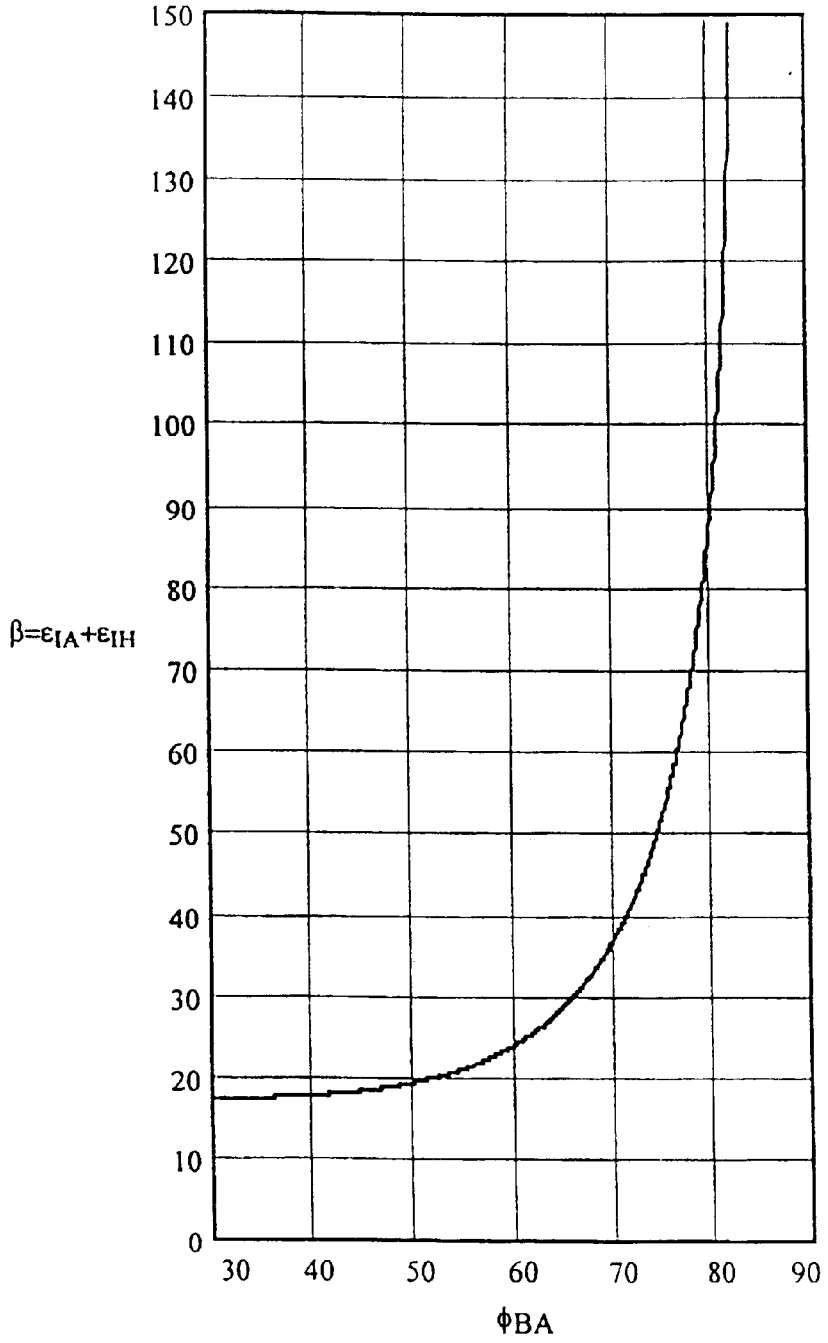

FIG. 10 is a plot of the relationship between $\phi_{BA}$ and the apparent wind angle $\beta$ for representative values of $\lambda$, $\theta$, $\epsilon_A$ and $\epsilon_H$.

Figure 11B:
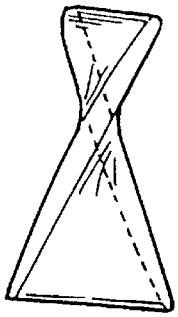
Figure 11A:
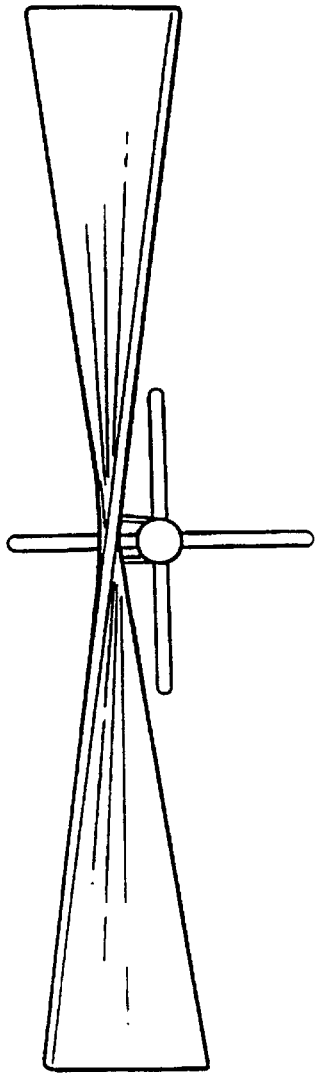
Figure 11C:
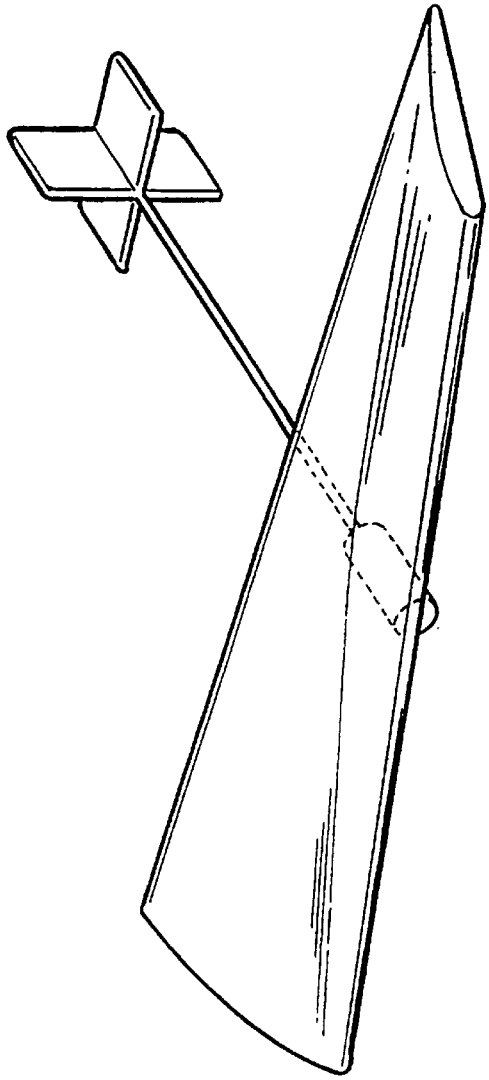
Figure 12A:
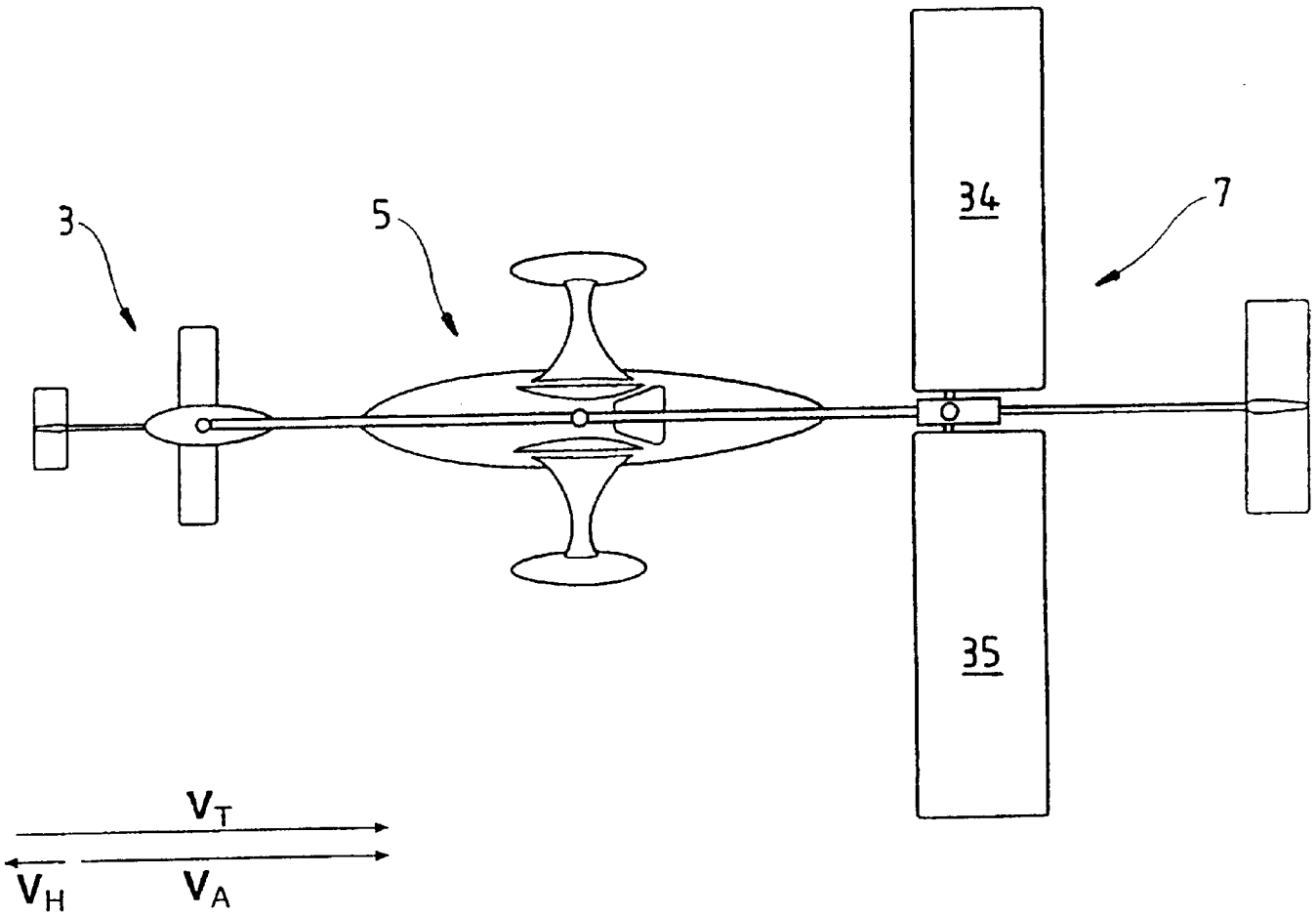
Figure 12B:
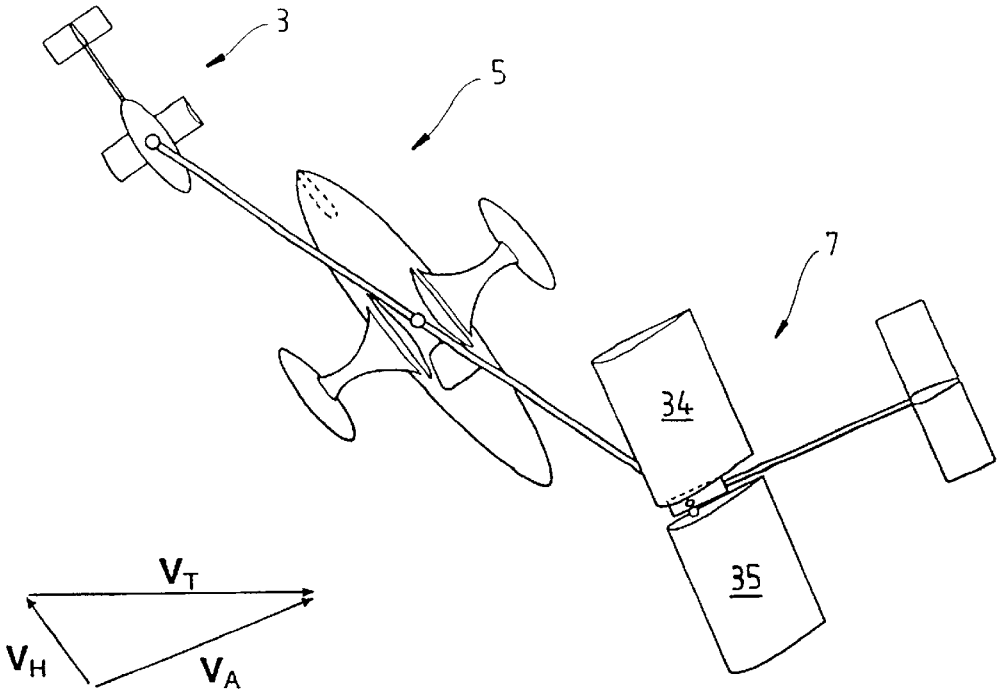
Figure 12C:
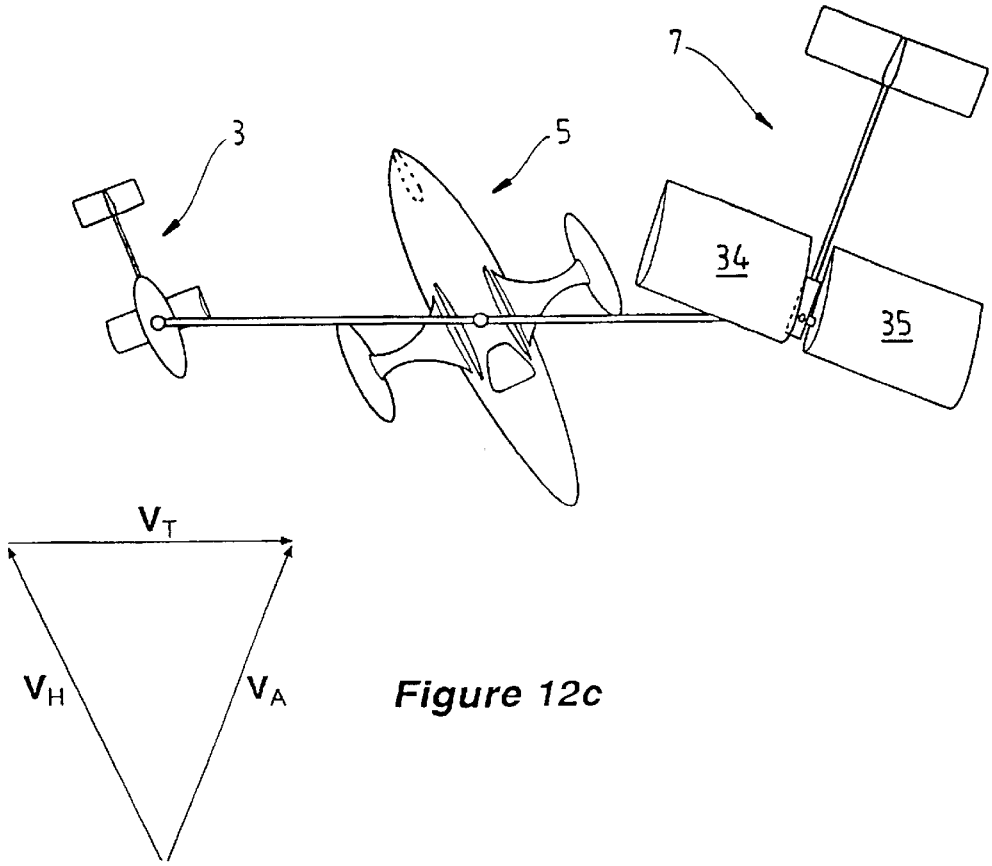
Figure 13A:
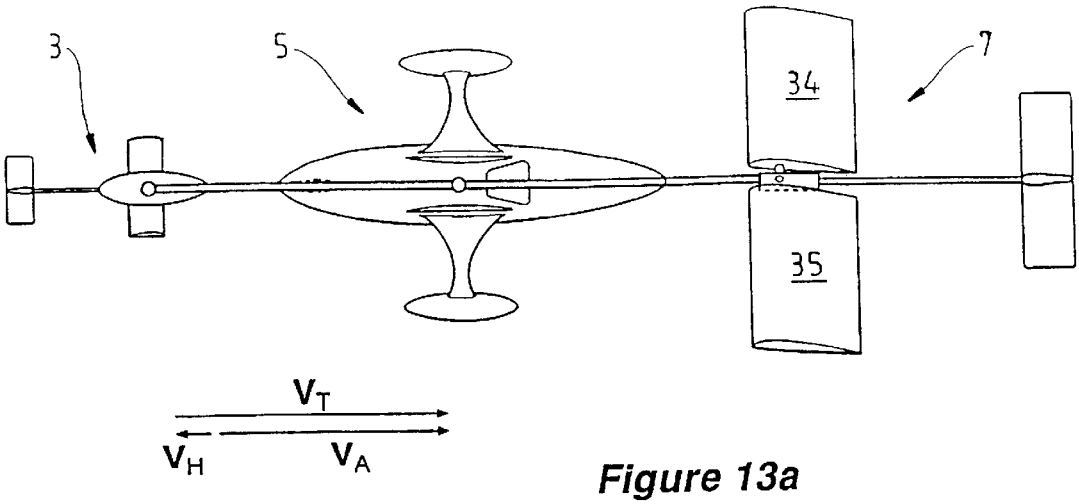
Figure 13B:
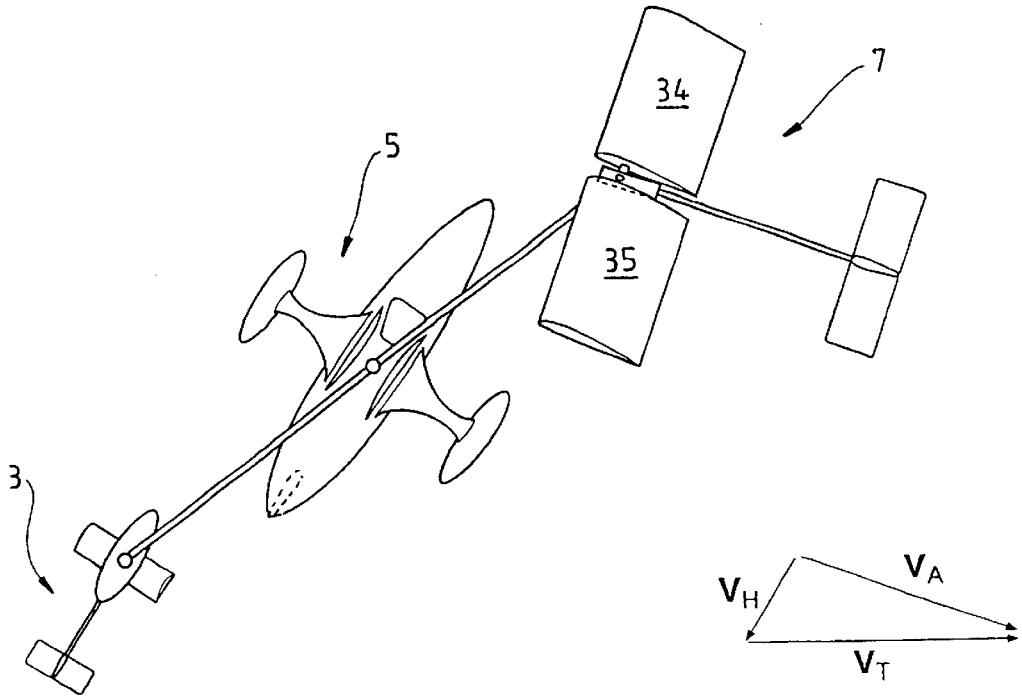

FIGS. 11*a*, 11*b* and 11*c* provide a front, side and perspective view respectively of a flexible and resilient aerofoil that is capable of twisting along its lateral axis in order to affect the pitch of the foil;

FIG. 12*a* provides a top view of the sailing craft of FIG. 3 without an aero rudder and cowlings on the rigid beam in a rest position in relation to a vector representing true wind;

FIGS. 12*b* and 12*c* provide top views of the craft of FIG. 12*a* as the craft is controlled to initially accelerate and achieve a steady sailing speed on a starboard tack in relation to a vector representing true wind;

FIGS. 13*a* and 13*b* provide top views of the craft of FIG. 12*a* as the craft is controlled to initiate movement of the foils and to initially accelerate on a port tack.

Figure 14A:
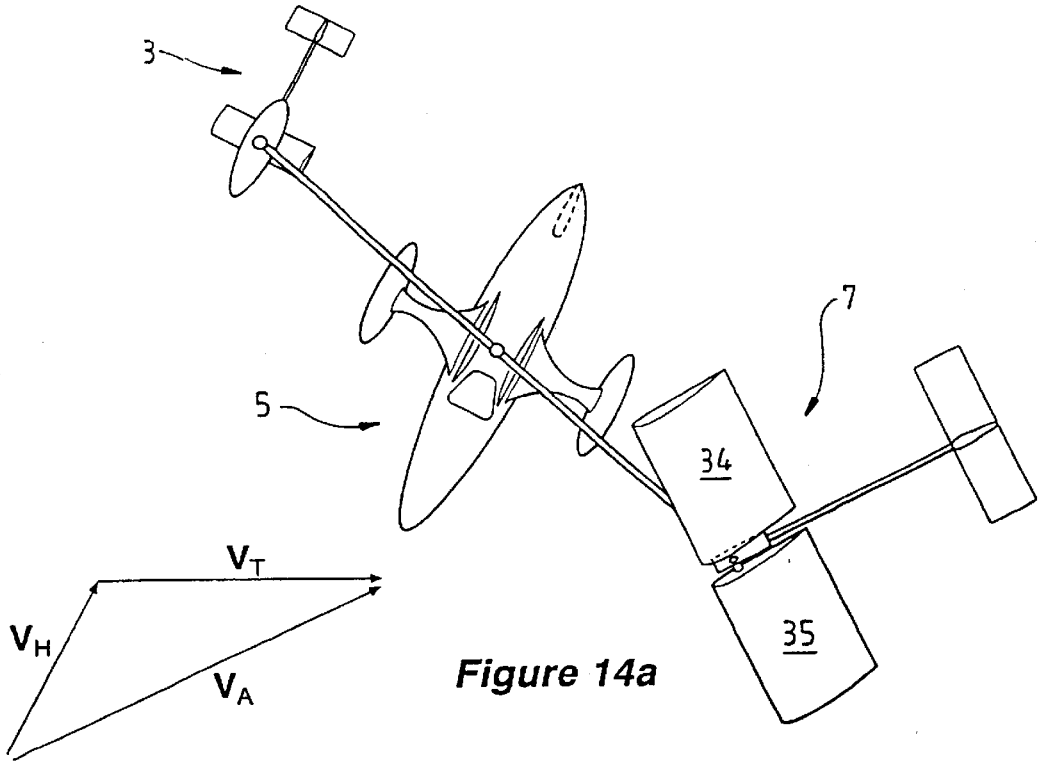
Figure 14B:
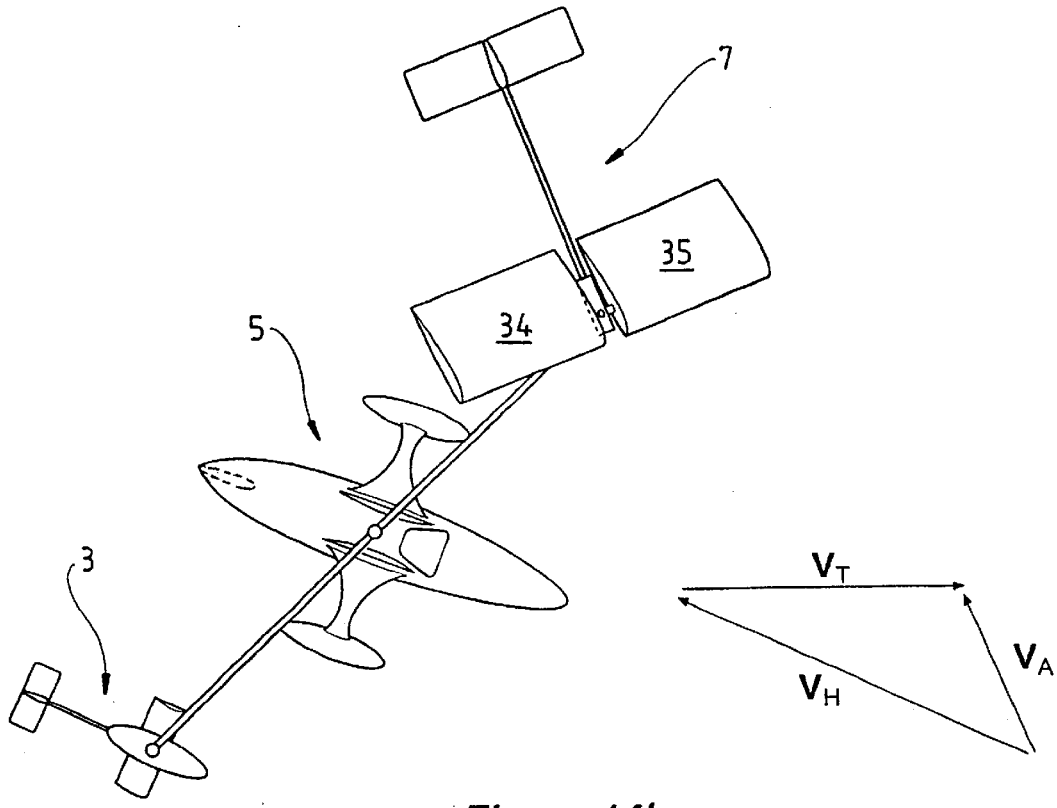

FIGS. 14*a* and 14*b* provide top views of the craft of FIG. 12*a* sailing upwind and downwind on a starboard tack in relation to a vector representing true wind.

With reference to FIG. 3, an improved sail craft according to the invention includes a hydrofoil assembly 3, a hull 5, an aerofoil assembly 7 and a rigid beam 8 interconnecting these main components.

The hydrofoil assembly 3 is connected to the rigid beam 8 by the hydro yaw gimbal 20 that enables hydrofoil assembly 3 to rotate freely about the axis designated 22. Hydrofoil member 10 is connected to a hydro roll gimbal (not detailed herein) such that the hydrofoil member 10 is able to rotate about an axis in the direction 18 and to rotate about the lateral axis of the hydrofoil member 10 in the direction 19. In a preferred embodiment stabilising foils 14 are mounted upon hydro boom 12 which is connected to the yaw gimbal. The hydrofoil assembly may also include a float 13 to provide the hydro yaw gimbal 20 with some flotation thereby acting to prevent complete immersion of the gimbal whilst the craft is at rest.

The connection between the rigid beam 8 and the hydrofoil assembly 3 only allows for rotation of the hydrofoil assembly about the yaw axis 22. The roll axis of the hydrofoil 18 is not co-incident with the yaw bearing but does intersect the continuation of the yaw axis 22. The separation of the yaw bearing from the roll axis enables the rigid beam to remain above the waterline. If any portion of the rigid beam was required to be submerged, the overall effect on drag would be significant.

In the preferred embodiment, the hydroboom 12 that is connected to the hydrofoil assembly 3, extends downstream from the hydrofoil member 10 and has stabilising foils 14 attached thereto. The foils 14 act to stabilise yaw movements of the hydrofoil assembly 3.

The ability of the hydrofoil assembly to freely rotate about the yaw axis designated 22 enables the lateral axis of the hydrofoil member 10 to be maintained generally transverse to the flow of water passing the hydrofoil member 10.

The hull 5 houses the crew and is also connected to the rigid beam 8 by way of a mount that enables rotation in the direction 25. The hull 5 also includes an aero rudder 27 and a hydro rudder 28. It is possible for the hull to not include any rudders or alternatively to include only an aero rudder 27 or a hydro rudder 28. In the instance of including only a hydro rudder 28, the rudder could be used to align the hull 5 with the apparent wind when the hull is airborne whilst enabling the hull to be aligned with the apparent water flow whilst waterborne thereby acting to minimise drag forces imparted to the hull whilst the hull is either airborne or waterborne. The use of a single hydro rudder also provides a secondary benefit in that the rudder could be used to obtain lateral resistance from the hull to assist the hydrofoil at low speeds. In FIG. 3, the embodiment includes both rudders and in this instance the aero rudder 27 and the hydro rudder 28 should not be simultaneously fixed as conditions may result in them acting in contention causing high levels of drag to be experienced by the craft. There are various solutions to this potential problem including active control of both rudders, or simply slaving the yaw control of the hull to the aero or hydro yaw gimbal.

Active control of both rudders provides maximum ability to control the hull but increases the complexity of operation for the pilot. A single hydro rudder could be included with a depth such that it maintains partial immersion even when the hull is airborne. In this instance, the hydro rudder could be on struts to maintain immersion thereby providing less drag as compared with a deep rudder of constant profile. In addition, a horizontal stabiliser near the base of the hydro rudder could be included. Pitch control on the stabiliser could also be included to optimise trim angle of the hull planing surface.

The hull also includes floats 31 and 32 that provide stability to the hull 5 when it rests upon the water, particularly when the hull is aligned with the beam 8 during a change of tack.

The rigid beam 8 extends from the hull 5 to the aerofoil assembly 7. The aerofoil assembly 7 is connected to an aero yaw gimbal (shown but not detailed herein) such that the aerofoil assembly 7 is able to rotate about the vertical axis designated 46. The aerofoil assembly is also connected to an aero roll gimbal (also shown but not detailed herein) such that the aerofoil assembly 7 is able to rotate about the axis designated 41. In the preferred embodiment of FIG. 3, the aerofoil assembly 7 includes a starboard aerofoil member 34 and a port aerofoil member 35 both of which are connected to the aero roll gimbal. Both aerofoil members, 34 and 35, are connected to the aero roll gimbal such that they are able to rotate about the lateral axis extending through each individual foil member designated 42.

In the preferred embodiment, the aerofoil assembly includes an aero boom 36 that is connected to the aero yaw gimbal. The boom 36 has dorsal and ventral fins 37 and a horizontal stabilising foil 38 mounted upon it.

The ability of the aerofoil assembly to freely rotate about the yaw axis, designated 46, enables the lateral axis of the aerofoil members, 34 and 35, to be maintained generally transverse to the flow of air passing the aerofoil members.

Controlling the angle of attack of the aerofoil members and the hydrofoil members refers to the control of the pitch of those foils (ie. rotation about the lateral axes 42 and 19 respectively). The pitch of either foil may be controlled directly or by the use of elevators mounted on struts behind the foils. With low moment foils, direct control of the pitch should be possible without requiring the exertion of forces greater than that achievable by the pilot. If foils of sufficiently low moment to enable unassisted pilot operation are not feasible, elevators may be used to reduce the force required. The use of elevators would also have the additional benefit of decoupling the pitch of the foil from the pitch of the main rigid beam.

Also detailed in FIG. 3 are aerodynamically shaped cowells 50 and 51. Preferably the cowells are mounted upon rigid beam 8 such that they may rotate about the longitudinal axis of the beam thereby enabling the cowells to adopt an orientation corresponding to the least drag. Rotation would be particularly preferred for cowell 50 extending over a substantial portion of the rigid beam 8 between the hull 5 and the aerofoil assembly 7 to ensure low drag on either tack. In order to reduce cost, the cowell 51 may be symmetrical and fixed. This is possible as cowell 51 is substantially horizontal in use and will generally not present a large cross sectional area to the wind irrespective of the travelling direction of the craft.

FIGS. 4*a* and 4*b* provide front and side views respectively of the hydrofoil assembly 3 detailing in particular the hydrofoil member 10 and the freedom of movement of the hydrofoil member 10 about a roll axis 18 and its lateral axis 19. The entire hydrofoil assembly is capable of rotation about a yaw axis 22.

FIGS. 5*a*, 5*b* and 5*c* provide top, front and side views respectively of the aerofoil assembly 7. In particular, FIG. 5*a* details in hidden line detail the freedom of movement of the aerofoil assembly about a yaw axis 46. FIGS. 5*b* and 5*c* detail the freedom of movement of the aerofoil members 34 and 35 about a roll axis 41 and a lateral 42 respectively. In the instance of the preferred embodiment, two separate aerofoil members 34 and 35 are used with both capable of independent rotation about their lateral axes.

FIG. 6*a* is a top view of a sail craft according to the present invention detailing various projected force vectors. It is in this figure that the correct analysis involving the projection of forces onto the horizontal plane is detailed.

In FIG. 6*a*, the hull includes a downstream extending boom attached to which is an aero rudder. In the instance of FIG. 6*a*, the aero rudder is aligned with the hull and accordingly, the hull adopts an orientation generally aligned with the flow of air passing the hull. With this particular configuration, the aerodynamic drag imported to the craft as a result of the hull is minimised.

On the left side of the diagrammatic representation of the craft of FIG. 6*a*, the projected hydrodynamic forces and angles are represented. On the right side, the projected aerodynamic forces and angles are represented.

The structure of the sailing craft includes a separation of the hydrofoil from generally vertical alignment with the aerofoil. As a result, the forces acting upon the hydrofoil and the aerofoil will not necessarily lie substantially parallel to the horizontal plane. However, as has been previously stated, it is the component of the actual forces acting parallel to the horizontal plane that is relevant to the analysis of the forces acting upon the craft to determine operation and performance of the craft.

The craft in FIG. 6*a* can be considered to be in a steady state condition if the craft is considered to be travelling at a constant velocity (ie no acceleration) with no rotation. From the reference frame of the craft, it appears that the water is flowing past the craft at a magnitude and direction represented by $V_H$. Similarly, the craft is subjected to an apparent wind of magnitude and direction represented by $V_A$.

In FIG. 6*a*, the hull is assumed to be airborne with negligible drag. The resultant force from the aerofoil acting upon the beam lies in the vertical plane through the beam. Similarly, the resultant force from the hydrofoil acting upon the beam also lies in the vertical plane through the beam. If this were not the case, there would be a resultant force acting upon the beam and the beam would accelerate in the direction of that resultant force. The force acting upon the beam from either the hydrofoil or the aerofoil can be reduced into components that are parallel and perpendicular to the direction of the apparent flow or the apparent wind vectors. As such, these components represent the drag and lift components of the overall force resulting from the foils.

However, it is important to consider the horizontal projection of the lift component of the force and this is represented as $L_{IH}$ for the hydrofoil (ie the horizontal component of the hydrodynamic force acting perpendicular to the direction of the apparent flow) and $L_{IA}$ for the aerofoil (ie the horizontal component of the aerodynamic force acting perpendicular to the direction of the apparent wind). The horizontal components of the hydrodynamic and aerodynamic forces, that is the components parallel to the plane of the interface, are represented as $F_{IH}$ and $F_{IA}$ respectively.

The projection of the hydrodynamic and aerodynamic drag angles are represented as $\epsilon_{IH}$ and $\epsilon_{IA}$ respectively and are the angles between the components of the overall forces parallel to the horizontal plane and the lift components of the forces parallel to the horizontal plane.

From the construction of the geometry, it can be readily seen that the angle of yaw for the aerofoil, represented as $\psi_A$, is equal to the aerodynamic drag angle $\epsilon_{IA}$ and similarly, the angle of yaw for the hydrofoil, represented as $\psi_H$, is equal to the hydrodynamic drag angle $\epsilon_{IH}$.

With reference to FIG. 6*b*, the vector diagram represents the transposition of the apparent wind vector and the apparent flow vector such that the apparent wind angle is formed. As the apparent wind angle is the sum of the hydrodynamic and aerodynamic yaw angles, then:

$$\beta=\epsilon_{IH}+\epsilon_{IA}$$

As has been stated previously, the applicant has recognised that correct analysis of the forces involves the analysis of the component of those forces parallel to the horizontal plane. Of equal importance in this regard is the consequent recognition that the apparent wind angle is the sum of the projections of the drag angles onto the horizontal plane.

FIGS. 7*a*, 7*b* and 7*c* detail the analysis of the overall resultant aerodynamic, hydrodynamic and gravitational forces acting upon the beam of the sail craft.

FIG. 7*a* is a diagrammatic representation of the craft detailing the three resultant forces acting upon the craft and the location of those forces. The aerodynamic force is represented by $F_A$ and acts at the aerodynamic centre of pressure of the craft, represented as ACP. Similarly, the hydrodynamic force is represented by $F_H$ and acts at the hydrodynamic centre of pressure of the craft which is represented as HCP. The gravitational force on the craft is represented as W, for weight, and acts at the centre of gravity of the craft, represented as CG.

Of course, the above description and accompanying diagrammatic representations referring to forces lying in a vertical plane through the rigid beam is an approximation that ignores the effects of drag forces on the hull and beam. The effect of drag forces acting on these components of the craft is away from the direction of travel and as such, the forces $F_A$ and $F_H$ would have a component in the direction of travel to balance the drag forces. Drag forces would be most pronounced with the hull waterborne. However, for the sake of simplicity, these drag forces are considered to be negligible when the hull is airborne.

Although it is generally desirable to minimise the weight of the craft, the use of counterweights may be required to avoid unbalanced gravitational forces that could overwhelm the effects of stabilisers. Counterweights may also be required in relation to either or both foils. The term "flutter" is used to describe oscillations in the angle of attack of a foil and is generally caused by unbalanced inertial forces resulting from acceleration of the foils. Accordingly, counterweights may be required to balance the lift and control surfaces of the foils about the lateral axes to prevent flutter.

FIG. 7*b* represents the vector summation of the three main forces and the fact that they must sum to zero. The required relative magnitudes of $F_A$ and $F_H$ can be obtained by adjusting the relative pitch of the aero and hydrofoils. The pitch adjustment also compensates for relative differences in $V_A$ and $V_H$. FIG. 7*c* effectively repeats the force diagram of FIG. 7*a* without the representation of the main elements of the craft. The horizontal distance between the hydrodynamic centre of pressure and the aerodynamic centre of pressure is designated as "b" and the variable $\lambda$ represents the horizontal distance from the hydrodynamic centre of pressure to the centre of gravity as a fraction of the overall width. Of particular importance in this Figure is the definition of the angles $\phi_{BH}$ and $\phi_{BA}$ as those angles between the actual force and the horizontal plane. Also of importance is the definition of the angle $\theta$ between the horizontal plane and a straight line joining the hydrodynamic centre of pressure and the aerodynamic centre of pressure.

The values of the angles Of $\phi_{BA}$ and $\phi_{BH}$ are limited as follows:

$$-\theta \le \phi_{BH} \le \frac{\pi}{2} - \varepsilon_H \qquad \theta \le \phi_{BA} \le \frac{\pi}{2} - \varepsilon_A$$

and given that the three resultant forces must pass through a single point, the following relationship can be established:

$$(1-\lambda)\tan\phi_{BA} = \tan\theta + \lambda\tan\phi_{BH}$$

FIG. 8 details the nomenclature used in the decomposition of the forces and lift components thereof into components that reside parallel to the horizontal plane. The following relationships can be established:

$$\sin\varepsilon_{IH} = \frac{\sin\varepsilon_H}{\cos\phi_{BH}} \qquad \sin\varepsilon_{IA} = \frac{\sin\varepsilon_A}{\cos\phi_{BA}}$$

FIG. 9 is a plot of the relationship between the angles $\phi_{BA}$ and $\phi_{BH}$ for representative values of $\lambda$ and $\theta$. In the particular instance of FIG. 9, $\lambda$=0.5 and $\theta$=30° results in the plot of $\phi_{BH}$ versus $\phi_{BA}$ detailed.

Using the above equations, for given values of $\epsilon_A$, $\epsilon_H$, $\lambda$ and $\theta$, it is possible, for any feasible value of $\phi_{BA}$, to evaluate $\epsilon_{IA}$ and $\epsilon_{IH}$ and hence their sum, which equals $\beta$.

FIG. 10 is a plot of the relationship between $\phi_{BA}$ and the apparent wind angle $\beta$ for the same adopted values for $\lambda$ and $\theta$ as for FIG. 9 and $\epsilon_A=\epsilon_H=7.5°$. As can be seen from the plot of FIG. 10, the apparent wind angle ($\beta$) remains close to its minimum value for a considerable range of values for $\phi_{BA}$. This result supports the contention that it should be possible to construct a sailing craft with improved performance as compared with conventional prior art craft in winds over 15 knots and possibly as low as 10 knots.

In order to obtain small projected drag angles on the horizontal plane (i.e. $\epsilon_{IA}$ and $\epsilon_{IH}$) and hence a small apparent wind angle ($\beta$) and high relative speed compared with the true wind speed $V_T$, it is necessary to have a small angle between the horizontal plane and the straight line joining the hydrodynamic centre of pressure to the aerodynamic centre of pressure (ie $\theta$), small drag angles ($\epsilon_A$ and $\epsilon_H$) and low weight as compared with the foil forces $F_A$ and $F_H$.

It is preferable to construct the foils such that at least one is relatively thick. From the following basic fluid dynamic equations it can be readily seen that the lift and drag of a foil is proportional to the square of the velocity of the fluid passing over the foil. It can also be seen from the last relationship that the coefficient of lift is proportional to the angle of attack ($\alpha$):

$$L = C_L\frac{1}{2}\rho V^2 S \qquad C_L \approx 2\pi\alpha \qquad D = C_D\frac{1}{2}\rho V^2 S$$

For the above equations, it should be noted that $\rho$ represents fluid density, S represents the foil area and $C_D$ represents the coefficient of drag.

As $\phi_{BA}$ and $\phi_{BH}$ vary, the relative magnitudes of $F_A$ and $F_H$ must vary. As the point of sailing varies, the relative magnitudes of $V_A$ and $V_H$ vary, and the force is proportional to the square of these values. In order to achieve equilibrium, over a range of values for $V_T$ and over a range of points of sail, it is necessary to vary either or both $C_{LA}$ and $C_{LH}$ (ie the coefficient of lift of the aerofoil and hydrofoil respectively). Thick foil sections give good lift to drag ratios over a wide range of angles of attack $\alpha$ and hence coefficients of lift $C_L$. However, thick foils are not necessary to obtain a high lift to drag ratio or a high coefficient of lift. In fact it is only necessary to vary the ratio of $C_{LA}$ and $C_{LH}$, and this can be achieved by only varying one of the values, that is one foil could be thin, or optimised for a small range of $\alpha$. In addition, the invention enables the use of rigid asymmetric foils.

One of the most important aspects of controlling the craft is the control of the foils about the roll axis. Roll can be controlled directly, or by creating an imbalance on the upper and lower foils, eg by individually varying the pitch/attack angle of individual foils, or via ailerons or wing warping for example. So, both roll $\phi$ or roll rate ($d\phi/dt$) can be controlled. Direct roll control allows control in very light wind. Roll rate control requires less pilot exertion, and is easier (hence cheaper) to implement.

With roll rate control it may be difficult to control the roll of either of the foil assemblies and especially the hydrofoil at high speeds. However, it is expected that damping could be introduced to overcome this potential problem. For example, fixing the boom of the foil to the roll gimbal would cause the stabilisers to provide some roll damping. Damping is increased by moving the area of the stabilisers away from the axis, using high aspect ratio or a "paddle" plan form.

Further blades could be added to assist in this regard. Additionally, or as an alternative, rotation of the stabilisers could be amplified through gearing.

Also, a dihedral on the foils could be used to generate a restoring force to counter roll. However, this would need to be carefully considered as yaw movements will generally lead to dihedral induced roll.

Alternatively roll of the foils could be controlled by roll demand control. If the demanded roll angle is denoted by $\phi_{demand}$ then the difference between the actual roll angle ($\phi$) and $\phi_{demand}$ determines the roll rate.

$$\frac{d\phi}{dt} = \phi_{demand} - \phi$$

The pilot can control $\phi_{demand}$ with a control mechanism implemented by means such as cables, gears, linkages or hydraulics. The difference between the actual and required roll angle could be used to generate a roll rate, by generating a difference in the pitch of the upper and lower foils. In addition, it may be useful to include a torsion bar connecting the foils which would assist in equalising the foils at low speeds.

The true wind speed varies with height above the water as a result of the effect known as wind shear. Therefore, the apparent wind speed and direction will vary with height above the water. If both foil members of the aerofoil have the same pitch, the forces on each foil may not be balanced about the roll axis. The resulting roll torque could be excessive for direct roll control whilst roll rate control or roll demand control will automatically compensate for this imbalance.

Failure to maintain full immersion of the hydrofoil could have an effect similar to wind shear. Forces on upper and lower hydrofoils, or portions of a single hydrofoil, could lead to excessive roll torque. This could be averted by temporarily reducing pitch or alternatively, roll demand control could be used to automatically compensate.

Roll rate control, roll demand control, and wind shear compensation can be achieved by the use of a foil that is sufficiently flexible and resilient to enable the foil to be "warped" or twisted over the length of the foil. The technique of wing warping has the advantage in that it can be tuned to provide optimum performance of the foil in the presence of wind shear. FIGS. 11*a*, 11*b*, and 11*c*, detail a front, side and perspective view respectively of a single aerofoil in a warped or twisted condition as may occur during use. In its normal condition the foil is relatively planar and for the control of pitch by this technique the foil must exhibit sufficient properties of flexibility and resilience.

Port and Starboard Tack

The improved sail craft of this invention can be sailed on both port and starboard tacks.

FIGS. 12*a* to 14*b* depict an improved sailing craft according to the present invention wherein the hull includes a hydro rudder that is rearward and downward of the hull. As such, the hull adopts an orientation generally aligned with the flow of water past the hydro rudder when waterborne. In the instance of FIGS. 12*a* to 14*b*, the hydro rudder is sufficiently long to remain partially immersed in the water at the operating airborne height of the hull. Accordingly, the hull maintains an orientation generally aligned with the flow of water past the hydro rudder when the hull is airborne.

However, it is feasible to include a hydro rudder that does not remain immersed in the water at the operating airborne height of the hull. In this instance, an aero rudder could be used to control the alignment of the hull when airborne.

FIG. 12*a* represents a top view of an improved sailing craft according to the present invention in a rest position. Vectors representing the true wind ($V_T$), apparent wind ($V_A$) and apparent flow ($V_H$) are also provided for purposes of illustration. In the rest position of FIG. 12*a*, the hull is resting upon the water.

To initiate a starboard tack, the aerofoil members 34 and 35 are rolled and pitched about their lateral axes to generate a force upon the beam in the required direction. This creates an initial acceleration of the craft as depicted in FIG. 12*b*. The water rudder aligns the hull with the direction of movement. At this stage the hull remains waterborne.

FIG. 12*c* represents the sailing craft on a starboard tack at a relatively constant speed. At this stage the hull is airborne and the forces acting upon the craft are in a steady state condition.

A reversal of this process from the steady state condition will return the craft to the rest position depicted in FIG. 12*a*. From this rest position, the aerofoil members 34 and 35 may then be rolled and pitched to generate a force upon the beam in the direction required for port tack as depicted in FIG. 13*a*.

The craft will then accelerate on port tack as depicted in FIG. 13*b*.

FIGS. 14*a* and 14*b* are further examples of a steady state constant speed on starboard tack, in upwind and downwind directions respectively.

It is possible that other design compromises may have a beneficial impact on performance of the craft. These factors could include avoidance of cavitation on the hydrofoil by limiting the range of $\alpha_H$ (ie the angle of attack of the hydrofoil). On the other hand, the span of the aerofoil has a large effect on $\theta$, and so a small span operating at maximum $C_{LA}$ may be desirable in order to maintain the angle $\theta$ as small as possible.

Recognition of the relevant forces to be considered in the analysis of the sail craft has enabled the applicant to gain a better understanding of the interaction of the relevant forces and hence the impact of the choice of various structural features of a sail craft design. As a result of the analysis, the applicant has devised a novel sail craft that theoretically provides improved speed performance whilst retaining sufficient control to provide the ability to sail on both tacks.

Finally, it should be appreciated that there may be other variations and modifications to the configurations described herein that are also within the scope of the present invention.

What is claimed is:

1. A wind powered sailing craft comprising:

a hydrofoil assembly;

an aerofoil assembly;

a rigid beam; and a hull connected to the rigid beam wherein, the hydrofoil assembly and the aerofoil assembly, are located at opposite ends of the rigid beam and the hull is separate and displaced from both the hydrofoil assembly and the aerofoil assembly, and wherein during use, the aerofoil assembly is displaced either partially or fully downwind with respect to the hydrofoil assembly and wherein a line of action of a resultant force of the aerofoil assembly and a line of action of a resultant force of the hydrofoil assembly pass approximately through a common point located on a vertical line through the center of gravity of the craft, said resultant forces of the hydrofoil and aerofoil assemblies both being directed away from said common point, said resultant forces of the hydrofoil and aerofoil assemblies having horizontal components which are substantially equal in magnitude and opposite in direction, said resultant force of the aerofoil assembly having a vertical component which is directed upwards, said resultant force of the hydrofoil assembly having a vertical component which may vary continuously between an upwards and downwards direction and wherein the sum of the vertical components of said resultant forces of the hydrofoil and aerofoil assemblies is directed upwards and is substantially equal in magnitude to the weight of the craft.

2. The wind powered sailing craft of claim 1, wherein the hull is connected to the rigid beam such that the hull is able to rotate about a vertical axis.

3. The wind powered sailing craft of claim 1, comprising at least one of the hydrofoil assembly further including at least one hydrofoil member having a lateral axis that, in use, is capable of rotation about an axis generally aligned with the flow of water past the hydrofoil member and the aerofoil assembly further including at least one aerofoil member having a lateral axis that, in use, is capable of rotation about an axis generally aligned with the flow of air past the aerofoil member.

4. The wind powered sailing craft according to claim 1, wherein the hydrofoil assembly includes at least one hydrofoil member, and wherein the hydrofoil member is capable, in use, of rotation about an axis generally transverse to the flow of water past the hydrofoil member, the axis also being generally aligned with the lateral axis of the hydrofoil member.

5. The wind powered sailing craft of claim 1, wherein the aerofoil assembly includes at least one aerofoil member, and the at least one aerofoil member is capable, in use, of rotation about an axis generally transverse to the flow of air past the at least one aerofoil member, the axis also being generally aligned with the lateral axis of the at least one aerofoil member.

6. The wind powered sailing craft of claim 1, further comprising at least one of a hydrofoil assembly including at least one hydrofoil member and an aerofoil assembly including at least one aerofoil member and wherein at least one of the hydrofoil assembly and the aerofoil assembly are connected to the rigid beam such that, in use, each may rotate about generally vertical axes thereby maintaining the lateral axes of the at least one hydrofoil and aerofoil members generally transverse to the flow of water and air respectively passing the hydrofoil and aerofoil members.

7. The wind powered sailing craft according to claim 6, wherein the hydrofoil assembly includes a hydrofoil boom and stabilizing foils attached thereto, the hydrofoil boom being fixedly attached to the assembly and extending downstream of the hydrofoil member and acting to assist maintaining the hydrofoil member lateral axis generally transverse to the flow of water passing the hydrofoil member and stabilizing yaw movements of the hydrofoil assembly.

8. The wind powered sailing craft according to claim 6, wherein the aerofoil assembly includes an aerofoil boom and stabilizing foils attached thereto, the aerofoil boom being fixedly attached to the assembly and extending downwind of the aerofoil member and acting to assist maintaining the aerofoil member lateral axis generally transverse to the flow of air passing the aerofoil member and stabilizing yaw movement of the aerofoil assembly.

9. The wind powered sailing craft of claim 1, wherein the hydrofoil assembly includes at least one hydrofoil member, the at least one hydrofoil member being separate and displaced from the connection between the rigid beam and the hydrofoil assembly.

10. The wind powered sailing craft according to claim 9 wherein the hydrofoil assembly is connected to the rigid beam such that, in use, it may rotate about a generally vertical axis and the hydrofoil member, in use, is capable of rotation about an axis generally aligned with the flow of water past the hydrofoil member and wherein said axes substantially intersect.

11. The wind powered sailing craft of claim 2, wherein the hull includes at least one of a rudder disposed rearwardly and upwardly from the hull and a rudder disposed rearwardly and downwardly from the hull.

12. The wind powered sailing craft according to claim 11 wherein the rudder disposed rearwardly and upwardly from the hull and the rudder disposed rearwardly and downwardly from the hull are capable, in use, of being independently controlled.

13. The wind powered sailing craft of claim 1, wherein the hydrofoil assembly includes a hydrofoil assembly float member connected to the hydrofoil assembly adapted to inhibit the connection between the rigid beam and the hydrofoil assembly becoming submerged.

14. The wind powered sailing craft of claim 1, wherein the hull includes hull float members attached thereto to provide stability to the hull whilst resting upon the surface of the water.

15. The wind powered sailing craft of claim 1, further including a cowell extending over a substantial portion of the rigid beam wherein the cowell is attached to the rigid beam so as to be rotatable about a longitudinal axis of the rigid beam.

16. The wind powered sailing craft of claim 1, wherein the aerofoil assembly includes at least one aerofoil member, said at least one aerofoil member comprising a flexible and resilient member that is capable, in use, of being twisted about an axis generally transverse to the flow of air past the at least one aerofoil member, the axis also being generally aligned with the at least one lateral axis of the aerofoil member.

17. The wind powered sailing craft of claim 1, wherein the aerofoil assembly includes a plurality of aerofoil members each member being capable, in use, of rotation about an axis generally transverse to the flow of air past the aerofoil members with each axis also being generally aligned with the lateral axis of the individual aerofoil members.

18. A wind powered sailing craft according to claim 17 wherein the aerofoil assembly comprises two aerofoil members of substantially similar configuration.

19. A wind powered sailing craft according to claim 18 wherein the two aerofoil members are capable, in use, of independent rotation about an axis generally transverse to the flow of air past the aerofoil members, the axes also being generally aligned with the lateral axis of each aerofoil member, such that when independent rotation thereof is controlled, the rotation of the two foils can be used to effect rotation of the aerofoil members about an axis generally aligned with the flow of air past the aerofoil members.

20. The wind powered sailing craft of claim 1, wherein the hydrofoil assembly includes a plurality of hydrofoil members each member being capable, in use, of rotation about an axis generally transverse to the flow of water past the hydrofoil members, the axis also being generally aligned with the lateral axis of the hydrofoil members.

21. A wind powered sailing craft according to claim 20 wherein the hydrofoil assembly comprises two hydrofoil members of substantially similar configuration.

22. A wind powered sailing craft according to claim 21 wherein the two separate hydrofoil members are capable, in use, of independent rotation about an axis generally transverse to the flow of water past the hydrofoil members, the axes of rotation also being generally aligned with the lateral axis of each hydrofoil member, such that when independent rotation thereof is controlled, the rotation of the two foils can be used to effect rotation of the hydrofoil members about an axis generally aligned with the flow of water past the hydrofoil members leading edges.

23. The wind powered sailing craft according to claim 1, wherein a center of pressure of the hydrofoil assembly is separate and displaced from the connection between the rigid beam and the hydrofoil assembly.

24. The wind powered sailing craft according to claim 23, wherein the hydrofoil assembly is connected to the rigid beam such that, in use, it may rotate about a generally vertical axis, and the center of pressure of the hydrofoil assembly lies approximately on said axis.

25. A wind powered sailing craft comprising:

a hydrofoil assembly comprising a hydrofoil member having a lateral axis that, in use, is capable of rotation about an axis generally aligned with the flow of water past the hydrofoil member; and a hydrofoil boom and stabilizing foils attached thereto, the hydrofoil boom being fixedly attached to the hydrofoil assembly and extending downstream of the hydrofoil member and acting to assist maintaining the hydrofoil member lateral axis generally transverse to the flow of water passing the hydrofoil member and stabilizing yaw movements of the hydrofoil assembly;

an aerofoil assembly comprising an aerofoil member having a lateral axis that, in use, is capable of rotation about an axis generally aligned with the flow of air past the aerofoil member;

a hull; and a rigid beam interconnecting the hydrofoil assembly, the aerofoil assembly, and the hull, wherein the hull is separate and displaced from the hydrofoil assembly and is, in use, at least partially supported above the Water by connection to the rigid beam wherein the hydrofoil assembly and the aerofoil assembly are connected to the rigid beam such that, in use, they may rotate freely about generally vertical axes thereby maintaining the lateral axes of the hydrofoil and aerofoil members generally transverse to the flow of water and air respectively passing the hydrofoil and aerofoil members.

26. A wind powered sailing craft comprising:

a hydrofoil assembly comprising a hydrofoil member having a lateral axis that, in use, is capable of rotation about an axis generally aligned with the flow of water past the hydrofoil member;

an aerofoil assembly comprising:

an aerofoil member having a lateral axis that, in use, is capable of rotation about an axis generally aligned with the flow of air past the aerofoil member; and an aerofoil boom and stabilizing foils attached thereto, the aerofoil boom being fixedly attached to the aerofoil assembly and extending downwind of the aerofoil member and acting to assist maintaining the aerofoil member lateral axis generally transverse to the flow of air passing the aerofoil member and stabilizing yaw movements of the aerofoil assembly;

a hull; and a rigid beam interconnecting the hydrofoil assembly, the aerofoil assembly, and the hull, wherein the hull is separate and displaced from the hydrofoil assembly and is, in use, at least partially supported above the water by connection to the rigid beam wherein the hydrofoil assembly and the aerofoil assembly are connected to the rigid beam such that, in use, they may rotate freely about generally vertical axes thereby maintaining the lateral axes of the hydrofoil and aerofoil members generally transverse to the flow of water and air respectively passing the hydrofoil and aerofoil members.

27. A wind powered sailing craft comprising:

a hydrofoil assembly;

an aerofoil assembly;

a hull;

a rigid beam interconnecting the hydrofoil assembly, the aerofoil assembly, and the hull, wherein the hull is separate and displaced from both the hydrofoil assembly and the aerofoil assembly and is, in use, at least partially supported above the water by connection to the rigid bean; and a cowell extending over a substantial portion of the rigid beam wherein the cowell is attached to the rigid beam so as to be rotatable about a longitudinal axis of the rigid beam.

28. A wind powered sailing craft comprising:

a hydrofoil assembly comprising a hydrofoil member having a lateral axis that, in use, is capable of rotation about an axis generally aligned with the flow of water past the hydrofoil member;

an aerofoil assembly comprising an aerofoil member having a lateral axis that, in use, is capable of rotation about an axis generally aligned with the flow of air past the aerofoil member and wherein the aerofoil member comprises a flexible and resilient member that is capable, in use, of being twisted about an axis generally transverse to the flow of air past the aerofoil member, the transverse axis also being generally aligned with the lateral axis of the aerofoil member;

a hull; and a rigid beam interconnecting the hydrofoil assembly, the aerofoil assembly, and the hull, wherein the hull is separate and displaced from the hydrofoil assembly and is, in use, at least partially supported above the water by connection to the rigid beam.

29. A wind powered sailing craft comprising:

a hydrofoil assembly;

an aerofoil assembly comprises two aerofoil members of substantially similar configuration, each member being capable, in use, of rotation about an axis generally transverse to the flow of air past the aerofoil members with each axis also being generally aligned with the lateral axis of the individual aerofoil members;

a hull; and a rigid beam interconnecting the hydrofoil assembly, the aerofoil assembly, and the hull, wherein the hull is separate and displaced from the hydrofoil assembly and is, in use, at least partially supported above the water by connection to the rigid beam.

30. The craft of claim 29, wherein the two aerofoil members are capable, in use, of independent rotation about an axis generally transverse to the flow of air past the aerofoil members, the axes also being generally aligned with the lateral axis of each aerofoil member, such that when independent rotation thereof is controlled, the rotation of the two foils can be used to effect rotation of the aerofoil members about an axis generally aligned with the flow of air past the aerofoil members.

31. A wind powered sailing craft comprising:

a hydrofoil assembly comprising two hydrofoil members of substantially similar configuration, each member being capable, in use, of rotation about an axis generally transverse to the flow of water past the hydrofoil members, the axis also being generally aligned with the lateral axis of the hydrofoil members;

an aerofoil assembly;

a hull; and a rigid beam interconnecting the hydrofoil assembly, the aerofoil assembly, and the hull, wherein the hull is separate and displaced from the hydrofoil assembly and is, in use, at least partially supported above the water by connection to the rigid beam.

32. The craft of claim 31, wherein the two separate hydrofoil members are capable, in use, of independent rotation about an axis generally transverse to the flow of water past the hydrofoil members, the axes of rotation also being generally aligned with the lateral axis of each hydrofoil member, such that when independent rotation thereof is controlled, the rotation of the two foils can be used to effect rotation of the hydrofoil members about an axis generally aligned with the flow of water past the hydrofoil members leading edges.

* * * * *